US008839464B2

(12) United States Patent
French

(10) Patent No.: US 8,839,464 B2
(45) Date of Patent: Sep. 23, 2014

(54) GARMENT POCKET FOR CARRYING AN OBJECT IN A CONCEALED STATE

(75) Inventor: Jay French, New Cumberland, PA (US)

(73) Assignee: CCW Breakaways LLC, New Cumberland, PA (US)

( * ) Notice: Subject to any disclaimer, the term of this patent is extended or adjusted under 35 U.S.C. 154(b) by 606 days.

(21) Appl. No.: 12/908,425

(22) Filed: Oct. 20, 2010

(65) Prior Publication Data

US 2011/0030126 A1 Feb. 10, 2011

Related U.S. Application Data

(63) Continuation-in-part of application No. 12/549,212, filed on Aug. 27, 2009, now Pat. No. 8,307,465, and a continuation-in-part of application No. 12/430,028, filed on Apr. 24, 2009, now Pat. No. 8,522,367, and a continuation-in-part of application No. 12/242,082, filed on Sep. 30, 2008, now Pat. No. 8,484,765.

(60) Provisional application No. 61/253,228, filed on Oct. 20, 2009, provisional application No. 61/190,598, filed on Aug. 29, 2008, provisional application No. 61/048,056, filed on Apr. 25, 2008, provisional application No. 61/048,043, filed on Apr. 25, 2008.

(51) Int. Cl.

| | |
|---|---|
| ***A41D 27/20*** | (2006.01) |
| ***F41C 33/00*** | (2006.01) |
| ***F41C 33/04*** | (2006.01) |

(52) U.S. Cl.

CPC ..... *A41D 27/20* (2013.01); *F41C 33/00* (2013.01); *F41C 33/048* (2013.01)

USPC ..... 2/248

(58) Field of Classification Search

USPC ..... 2/247, 248, 249, 250, 251, 252, 254, 2/94, 160, 466, 20, 21, 23, 19; 206/278, 206/282, 286, 292, 294, 384

See application file for complete search history.

(56) References Cited

U.S. PATENT DOCUMENTS

| | | | | |
|---|---|---|---|---|
| 309,292 | A | | 12/1884 | Browne |
| 936,437 | A | * | 10/1909 | Fields et al. ..... 2/160 |
| 1,116,643 | A | | 11/1914 | Strobel |
| 1,120,190 | A | | 12/1914 | Gaskill |
| 1,191,339 | A | | 7/1916 | Noye |
| 1,212,513 | A | | 1/1917 | Langerman |
| 1,886,718 | A | | 11/1932 | Noel |
| 1,887,780 | A | | 11/1932 | Noel |
| 1,970,110 | A | | 8/1934 | Vaccaro |
| 2,025,357 | A | * | 12/1935 | Pagan ..... 2/16 |
| 2,129,196 | A | * | 9/1938 | Boshnack et al. ..... 2/254 |
| 2,262,402 | A | | 11/1941 | Oppenheimer |
| 2,263,546 | A | | 11/1941 | Goldsmith et al. |
| 2,283,362 | A | | 5/1942 | Hamilton |
| 2,323,390 | A | | 7/1943 | Friedman |
| 2,489,148 | A | | 11/1949 | Ludwig |

(Continued)

*Primary Examiner* — Alissa L Hoey

(57) ABSTRACT

A garment pocket configured to carry, in a concealed and readily-accessible state, a handgun or other object is disclosed. The garment pocket has a receiving zone where the handgun or other object can be carried. The relative position of the receiving zone can be adjusted for the comfort of the wearer or to increase the concealment of the handgun or object in the receiving zone. In addition, a guard can be positioned on the outer surface of the pocket to prevent objects outside of the pocket from protruding into the receiving zone.

5 Claims, 28 Drawing Sheets

(56) References Cited

U.S. PATENT DOCUMENTS 2,527,224 A 10/1950 Landy
2,530,453 A 11/1950 Eagle
2,557,445 A 6/1951 Lewallen
2,593,795 A 4/1952 Rhoads et al.
2,604,627 A 7/1952 Abbott
2,671,902 A 3/1954 Grue
2,732,560 A 1/1956 Frederiksen, Sr.
2,810,132 A 10/1957 Nicholson
3,010,111 A * 11/1961 Ralph ..... 2/49.3
3,072,917 A 1/1963 Watson, Jr.
3,077,604 A 2/1963 Colangelo
3,137,866 A 6/1964 Stephens, Jr.
3,212,689 A 10/1965 Woolfolk
3,220,017 A 11/1965 Morton
3,310,053 A * 3/1967 Greenwood ..... 450/153
3,311,926 A * 4/1967 Gerber ..... 2/128
3,374,508 A 3/1968 Slimovitz
3,430,265 A * 3/1969 Mazza ..... 2/162
3,537,108 A 11/1970 Daniels
3,559,212 A * 2/1971 Skovron ..... 2/161.4
3,593,803 A * 7/1971 Ibach ..... 172/10
3,611,444 A 10/1971 Rector
3,723,994 A 4/1973 Tucker
3,751,731 A 8/1973 Bennett
3,782,614 A 1/1974 Campisi
4,035,844 A * 7/1977 Atack et al. ..... 2/466
4,051,553 A * 10/1977 Howard ..... 2/20
4,077,067 A 3/1978 Kozdal
4,123,804 A 11/1978 Michael et al.
4,138,745 A 2/1979 Greenspan
4,156,295 A 5/1979 LeRoy
4,235,356 A 11/1980 Atchisson
4,247,097 A * 1/1981 Schwartz ..... 482/105
4,262,832 A 4/1981 Perkins
4,318,503 A 3/1982 Capano
4,386,642 A 6/1983 Durbin
4,463,847 A 8/1984 Gordon
4,541,556 A 9/1985 Collins et al.
4,615,049 A * 10/1986 Samelian ..... 2/163
4,637,075 A 1/1987 Ingrisano et al.
4,651,355 A 3/1987 White
4,672,721 A 6/1987 Provost
4,675,914 A * 6/1987 Mitchell ..... 2/161.1
4,704,743 A * 11/1987 Thornell et al. ..... 2/161.1
4,741,465 A 5/1988 Johnson
4,791,681 A 12/1988 Dean
4,796,306 A * 1/1989 Mitchell ..... 473/205
4,827,535 A * 5/1989 Socey ..... 2/158
4,843,649 A 7/1989 Jewell et al.
4,846,383 A 7/1989 Gallagher
4,867,246 A * 9/1989 Kiger ..... 172/370
4,877,131 A 10/1989 Patros et al.
4,882,786 A 11/1989 Gross
4,898,310 A 2/1990 Remington
4,966,320 A 10/1990 DeSantis et al.
4,966,321 A 10/1990 Outlaw
4,995,119 A * 2/1991 Codkind ..... 2/161.7
4,998,654 A 3/1991 Bruzek et al.
5,022,094 A * 6/1991 Hames et al. ..... 2/163
5,035,003 A * 7/1991 Rinehart ..... 2/159
5,054,671 A 10/1991 Else
5,082,157 A 1/1992 Emerson-Santos
5,127,565 A 7/1992 Grant
5,152,442 A 10/1992 Gallagher
5,215,238 A 6/1993 Baruch
5,221,031 A 6/1993 Prigmore
5,255,392 A * 10/1993 Stanislaw ..... 2/247
5,294,031 A 3/1994 Volpei et al.
5,397,040 A 3/1995 Lee
5,400,438 A 3/1995 Staff et al.
5,419,474 A 5/1995 Marx et al.
5,421,032 A 6/1995 Murphy
5,444,874 A * 8/1995 Samelian et al. ..... 2/159
5,445,303 A 8/1995 Cawile, Jr.
5,453,064 A * 9/1995 Williams, Jr. ..... 482/47
5,476,439 A * 12/1995 Robinson ..... 601/40
5,495,967 A 3/1996 Parton
5,511,247 A * 4/1996 Block ..... 2/161.1
5,517,693 A * 5/1996 Noonan ..... 2/159
5,517,696 A * 5/1996 Krugler ..... 2/250
5,542,122 A 8/1996 Moldovan
5,584,424 A 12/1996 Stava
5,588,154 A 12/1996 Blauer et al.
5,638,549 A 6/1997 Thomas
5,662,219 A 9/1997 Tschudy et al.
5,666,667 A * 9/1997 Hook, Jr. ..... 2/159
5,692,237 A 12/1997 Bennett
5,706,521 A * 1/1998 Haney ..... 2/160
5,771,496 A 6/1998 Wood
5,800,900 A 9/1998 Mitchell
5,819,312 A * 10/1998 Snyder et al. ..... 2/16
5,829,653 A 11/1998 Kaiser
5,832,536 A 11/1998 Kramer
5,832,540 A 11/1998 Knight
5,864,884 A * 2/1999 Salvitti ..... 2/159
5,881,385 A * 3/1999 Hochmuth ..... 2/161.1
5,884,338 A 3/1999 Golde
5,901,372 A 5/1999 Lawler
5,909,834 A 6/1999 Parrott, III
5,924,565 A 7/1999 Colee
5,931,358 A 8/1999 Rogers
5,953,757 A 9/1999 Blanks
5,991,925 A 11/1999 Wu
6,010,473 A * 1/2000 Robinson ..... 602/21
6,014,774 A * 1/2000 Davey et al. ..... 2/158
6,076,715 A 6/2000 Easter
6,079,049 A 6/2000 Moir
6,082,600 A 7/2000 Angus et al.
6,105,170 A 8/2000 Lisciandro et al.
6,131,198 A 10/2000 Westrick
6,154,888 A 12/2000 Krohn
6,176,407 B1 1/2001 Jones et al.
6,199,218 B1 3/2001 Michael
6,244,400 B1 6/2001 Bowers
6,264,079 B1 7/2001 Skaggs
6,286,736 B1 9/2001 Angus et al.
6,289,517 B1 * 9/2001 Minkow et al. ..... 2/161.1
6,318,613 B1 11/2001 Underhill
6,374,421 B1 4/2002 Cleary
6,477,710 B1 * 11/2002 Ojoyeyi ..... 2/69
6,547,070 B1 4/2003 Kolpin
6,547,111 B2 4/2003 French
6,553,574 B1 * 4/2003 Hall et al. ..... 2/160
6,671,887 B1 1/2004 Eligan et al.
6,678,986 B2 * 1/2004 Roush ..... 42/94
6,681,402 B1 * 1/2004 Bevier et al. ..... 2/19
6,685,066 B2 2/2004 Cragg
6,760,922 B1 7/2004 Morales
6,763,527 B1 7/2004 Rivoli et al.
6,769,139 B1 8/2004 Goldkind
6,820,281 B2 11/2004 Mariland et al.
6,874,618 B1 4/2005 Cragg
6,926,182 B2 8/2005 Cragg
6,978,484 B2 12/2005 Donlan et al.
6,981,283 B2 * 1/2006 Kujawski ..... 2/161.6
6,986,164 B1 1/2006 Morales
6,990,689 B1 * 1/2006 Thellmann ..... 2/161.1
7,000,259 B2 * 2/2006 Matechen ..... 2/161.1
7,003,810 B2 2/2006 Goldkind
7,058,987 B2 6/2006 Salazar
7,152,247 B2 12/2006 Parsons
7,152,248 B2 12/2006 Ziemer
7,216,404 B1 5/2007 Doyle
7,571,495 B2 8/2009 Emeth
7,631,368 B1 12/2009 Samson
7,636,952 B2 * 12/2009 Fordham et al. ..... 2/164
7,637,218 B1 12/2009 Burton
7,644,448 B2 * 1/2010 Grilliot et al. ..... 2/161.6
7,681,255 B2 3/2010 Morales et al.
7,712,153 B2 * 5/2010 Adams, Jr. ..... 2/163
7,743,430 B2 6/2010 Jennings et al.
7,823,221 B2 * 11/2010 Green ..... 2/114
7,845,024 B2 * 12/2010 Hill ..... 2/310
7,918,371 B2 4/2011 Wilson

(56) References Cited

U.S. PATENT DOCUMENTS

| | | | | |
|---|---|---|---|---|
| 8,032,951 | B1 * | 10/2011 | Nestberg et al. | 2/247 |
| 8,060,948 | B2 | 11/2011 | Pesic | |
| 8,302,827 | B1 | 11/2012 | Cole | |
| 8,307,465 | B2 * | 11/2012 | French et al. | 2/250 |
| 8,312,568 | B2 * | 11/2012 | Marois et al. | 2/252 |
| 8,332,967 | B2 * | 12/2012 | Echikson | 2/250 |
| 2001/0032347 | A1 * | 10/2001 | Redwood et al. | 2/160 |
| 2003/0182714 | A1 | 10/2003 | Mariland et al. | |
| 2003/0205595 | A1 | 11/2003 | Young | |
| 2004/0244090 | A1 * | 12/2004 | Langer | 2/160 |
| 2005/0015844 | A1 | 1/2005 | Parsons | |
| 2005/0017034 | A1 | 1/2005 | Ausanio | |
| 2005/0022289 | A1 * | 2/2005 | Platt | 2/250 |
| 2005/0066424 | A1 | 3/2005 | Salazar | |
| 2005/0198872 | A1 | 9/2005 | Correa | |
| 2005/0223466 | A1 | 10/2005 | Jennings et al. | |
| 2005/0235398 | A1 | 10/2005 | Yoo | |
| 2006/0015987 | A1 | 1/2006 | Anderson | |
| 2007/0000965 | A1 | 1/2007 | Cannon, Jr. | |
| 2007/0245444 | A1 | 10/2007 | Brink | |
| 2007/0250980 | A1 | 11/2007 | Pellerin | |
| 2007/0254129 | A1 | 11/2007 | Horblitt | |
| 2008/0006659 | A1 | 1/2008 | Cain | |
| 2008/0125842 | A1 | 5/2008 | Petitt | |
| 2008/0163407 | A1 | 7/2008 | Gardner | |
| 2008/0216212 | A1 * | 9/2008 | Burgess et al. | 2/228 |
| 2008/0263742 | A1 | 10/2008 | Vaughn | |
| 2009/0025117 | A1 | 1/2009 | French | |
| 2009/0172861 | A1 | 7/2009 | Tomlinson et al. | |
| 2009/0199319 | A1 * | 8/2009 | Jenkin | 2/158 |
| 2009/0265835 | A1 | 10/2009 | French et al. | |
| 2009/0293170 | A1 | 12/2009 | Kiker | |
| 2010/0017943 | A1 | 1/2010 | Morales et al. | |
| 2010/0050312 | A1 | 3/2010 | French | |
| 2010/0299802 | A1 * | 12/2010 | Bailey et al. | 2/70 |
| 2010/0319108 | A1 | 12/2010 | King | |
| 2011/0030126 | A1 | 2/2011 | French | |
| 2011/0041231 | A1 * | 2/2011 | Behrens et al. | 2/69 |
| 2011/0231982 | A1 * | 9/2011 | Echikson | 2/115 |

* cited by examiner

GARMENT POCKET FOR CARRYING AN OBJECT IN A CONCEALED STATE

CROSS-REFERENCE TO RELATED APPLICATIONS

This application claims the benefit of U.S. Provisional Application No. 61/253,228, filed Oct. 20, 2009; is a continuation-in-part of U.S. application Ser. No. 12/549,212, filed Aug. 27, 2009, which claims the benefit of U.S. Provisional Application No. 61/190,598, filed Aug. 29, 2008; is a continuation-in-part of U.S. application Ser. No. 12/430,028, filed Apr. 24, 2009, which claims the benefit of U.S. Provisional Application No. 61/048,056, filed Apr. 25, 2008 and U.S. Provisional Application No. 61/048,043, filed Apr. 25, 2008; and is a continuation-in-part of U.S. application Ser. No. 12/242,082, filed Sep. 30, 2008, which claims the benefit of U.S. Provisional Application No. 61/048,043, filed Apr. 25, 2008.

BACKGROUND

The present application is directed to a garment pocket and, more specifically, to a garment pocket configured to carry, in a concealed and readily-accessible state, a handgun or other object (e.g., pepper spray, pocket tool, handcuffs, dagger, passport or other identification, wallet, valuables, etc.).

Law-enforcement personnel can be authorized to carry protection devices (e.g., handguns, stun guns, pepper sprays, etc.) while performing their duties. In addition, law-enforcement personnel may have to or want to carry other objects with them such as a pocket tool, handcuffs, dagger, passport or other identification, wallet, valuables, etc. However, when working undercover or on duty in plain clothes, law-enforcement personnel can have a problem with telegraphing, which is sometimes referred to as "profiling" or "mapping," of objects (e.g., a handgun) that they are carrying with them, but that need to be kept concealed from other individuals. As used broadly herein, "telegraphing" is the tendency for a concealed object (e.g., a handgun) to show through the concealing garment, rendering the concealed object readily detectable by others. Known carrying devices worn by law-enforcement personnel do not sufficiently minimize telegraphing. Furthermore, when the law-enforcement officer or wearer is wearing only one or two layers of clothing, such as when the wearer is dressed appropriately for warm weather or for working indoors in a temperature-controlled environment, the presence of the carrying device (and object being carried) becomes even more evident. In many instances, the carrying device, itself, can telegraph the potential presence of the object(s). Additionally, a carrying device such as a holster is generally limited in that the holster can properly carry only one type of handgun, leading law-enforcement personnel to require a different holster for each type of handgun they possess.

Accordingly, there is a need for a device that can carry, in a concealed and readily-accessible state, a handgun or other object. Additionally, there is a need for a device that is suitable for carrying, in a concealed and readily-accessible state, a variety different of handgun types or objects. Further, there is need for a device that can be easily configured to position a handgun or other object into a position desirable for a wearer of the device.

SUMMARY

One aspect of the invention is directed to a pocket for a garment. The pocket includes at least one piece of material configured and positioned to form a partially enclosed space having an opening to permit access to the partially enclosed space. The partially enclosed space includes a zone configured and positioned to substantially conceal and retain an object placed in the zone. The zone is at least partially defined by a boundary of the partially enclosed space formed by the at least one piece of material. The at least on piece of material has an exterior surface opposite the partially enclosed space. The pocket also includes a mechanism positioned on the exterior surface of the at least one piece of material to adjust the position of the zone relative to the opening of the partially enclosed space.

Another aspect of the invention is directed to a pocket for a garment. The pocket includes at least one piece of material configured and positioned to form a partially enclosed space having an opening to permit access to the partially enclosed space. The partially enclosed space includes a zone configured and positioned to substantially conceal and retain an object placed in the zone. The zone is at least partially defined by a boundary of the partially enclosed space formed by the at least one piece of material. The at least on piece of material has an exterior surface opposite the partially enclosed space. The pocket also includes a sleeve positioned on the exterior surface of the at least one piece of material near the zone and a guard positioned in the sleeve and configured to limit protrusions into the zone from objects outside the garment.

Among the advantages of the present application are that the wearer of the garment pocket can carry, in a concealed and readily-accessible state, a handgun or other object (e.g., pepper spray, pocket tool, handcuffs, dagger, passport, wallet, valuables, etc.). The garment pocket of the present application minimizes telegraphing of the handgun or other object and also renders it extremely difficult for a person other than the wearer to access the carried handgun or other object without the wearer's knowledge. Additionally, it is difficult for the wearer of the garment pocket to lose possession of the carried handgun or other object, including when the wearer is engaging in strenuous physical activity (e.g., fighting, running, jumping). The present application does not significantly compromise the wearer's freedom of movement because the handgun or other object, when mounted in the pocket or device, does not intersect (1) the line of flexion of the wearer's hip joint or (2) the line of flexion of the wearer's knee joint. For example, the ability of the wearer to kneel, run, and sit is not significantly compromised. The wearer also benefits from having "constant recognition" or "constant feel" that the handgun or other object is on his person because the object is carried adjacent to his inner thigh, increasing the possibility that the wearer would notice if the object went missing and decreasing the possibility that an attempt by an opponent to seize or "take-away" the object would be successful.

An advantage of one embodiment of the garment pocket of the present application is that the garment pocket can optionally be folded to assume and maintain either a first folded configuration or a second folded configuration. The garment pocket in the first folded configuration can carry, in an ergonomic position, a handgun having, for example, a medium-to-long barrel portion, whereas the garment pocket in the second folded configuration can carry, in an ergonomic position, a handgun having, for example, a relatively short barrel portion. Therefore, as a result of the first folded configuration and the second folded configuration, the garment pocket can carry several different types of handguns, and represents a significant and economical departure from the prevailing "one holster per handgun type" paradigm.

Other features and advantages of the present application will be apparent from the following more detailed description of the preferred embodiment, taken in conjunction with the accompanying drawings which illustrate, by way of example, the principles of the application.

BRIEF DESCRIPTION OF THE DRAWINGS

Wherever possible, the same reference numbers are used throughout the drawings to refer to the same or like parts.

DETAILED DESCRIPTION

Figure 1:
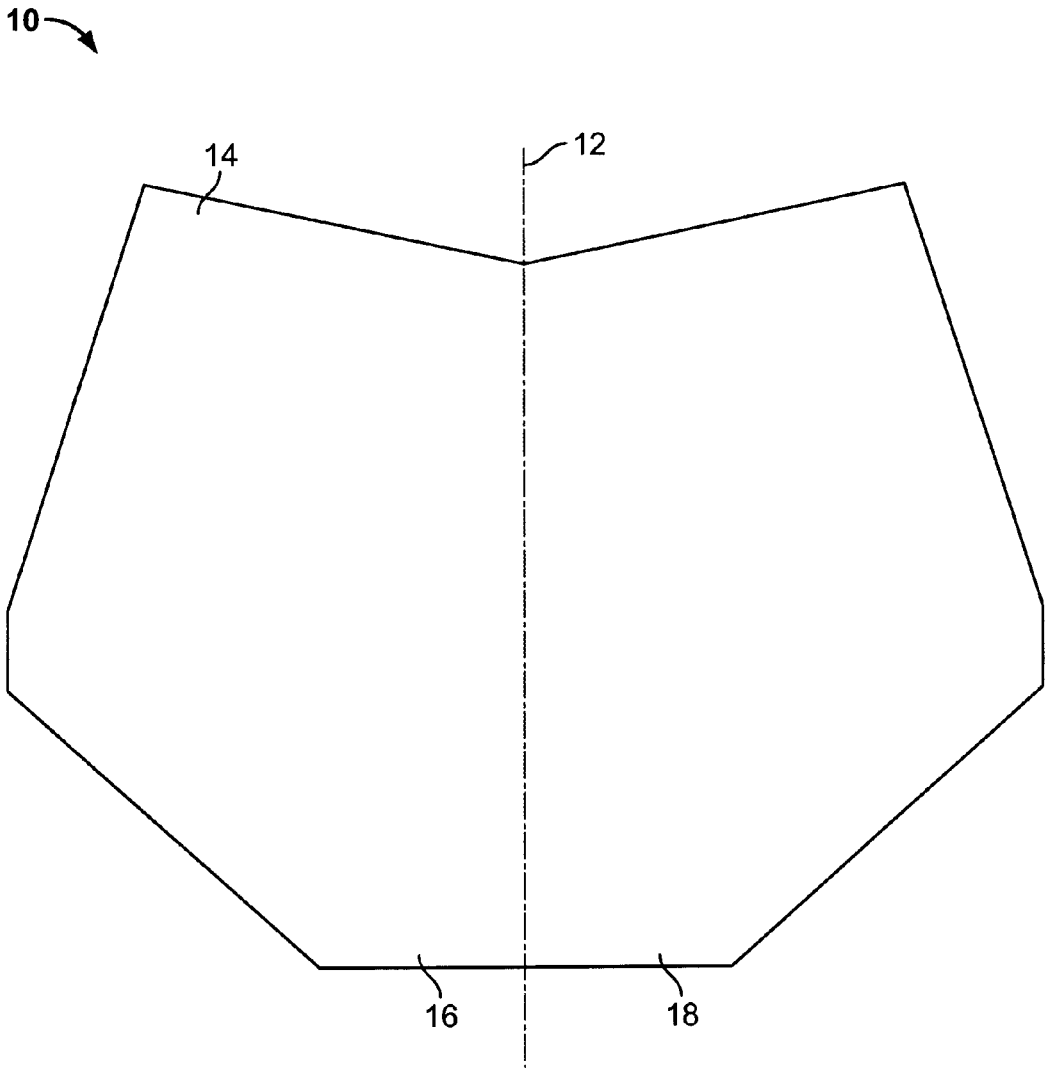
FIG. 1 shows a front plan view of an exemplary embodiment of an unsewn garment pocket.
Figure 2:
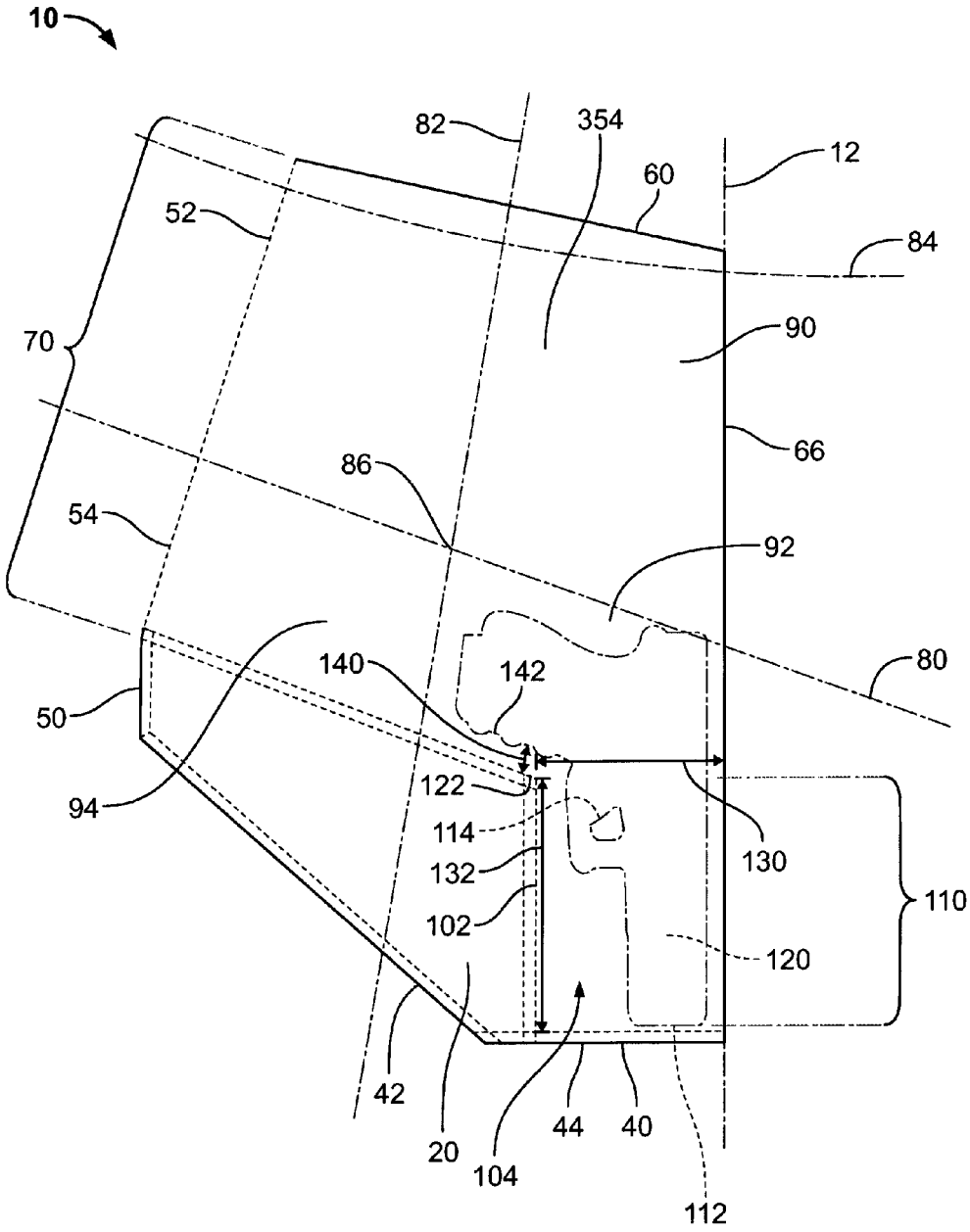
FIG. 2 shows a front plan view of an exemplary embodiment of a sewn garment pocket carrying a handgun having a relatively long barrel portion.

FIGS. 1 and 2 show different views of an exemplary embodiment of a garment pocket. Pocket 10, as shown in FIG. 2, can be configured for access by a wearer's right hand. In another embodiment, pocket 10 can be configured for access by a wearer's left hand. The configuration of pocket 10 for access by wearer's left hand can be a mirror image of the pocket 10 shown in FIG. 2. Pocket 10 can be incorporated into the right and/or left sides of a garment (e.g., pants, shorts, skirts) to be worn by a person. For illustrative purposes, FIG. 1 shows pocket 10 before the actual pocket is formed, and FIG. 2 shows a front view of pocket 10 after the actual pocket has been formed, such as by stitching, sewing, adhesives, fasteners or other suitable attachment or connection techniques or devices. As shown in FIGS. 1 and 2, pocket 10 can be formed, for example, by folding a single sheet of pliable material 14 along axis 12. Suitable examples of a pliable material include, without limitation, cotton, ripstop cloth, and ripstop nylon. In an alternate embodiment, pocket 10 can be manufactured using two or more pieces of pliable material. Referring to FIG. 1, first section 16 of pliable material 14, which is defined in part by axis 12, serves as the inner portion or part of pocket 10, i.e., the part of pocket 10 that is intended to be in closest proximity to the wearer's body. Second section 18 of pliable material 14, which is also defined in part by axis 12, serves as outer portion or part 20 (see FIG. 2) of pocket 10. In another exemplary embodiment, the location of first section 16 and second section 18 may be reversed for a "left hand" pocket. Outer part 20 is shown in FIG. 2, but the inner part is not, because outer part 20 and inner part 260 (see FIG. 12) can be substantially congruent. Upon formation of the actual pocket, as shown in FIG. 2, the surface of first section 16 shown in FIG. 1 serves as a first interior surface of pocket 10, and the surface of second section 18 shown in FIG. 1 serves as an (opposing) second interior surface of pocket 10. These two opposing interior surfaces border the partially enclosed space defined by the pocket 10.

Referring to FIG. 2, outer part 20 is fastened (e.g., seamed or sewn) to the corresponding inner part at least along (1) first segment 40 and second segment 42 of base edge 44, (2) segment 50 of outer edge 54, and (3) top edge 60. In embodiments using two or more pieces of pliable material to form pocket 10, outer part 20 can be additionally fastened to inner part 260 along inner edge 66.

Pocket 10, i.e., outer part 20 and inner part 260, can be fastened to the waistline of a garment along top edge 60. As used herein, "waistline" is defined as the part of a garment that generally covers the waistline of the person and/or an adjoining area above or below the waistline. Inner part 260 (but not outer part 20) can be fastened to the garment along segment 52 of outer edge 54, which coincides with opening 70 for pocket 10. Both outer part 20 and inner part 260 can be fastened to the garment along segment 50 of outer edge 54. Segment 50 can be used to maintain pocket 10 in a proper position following incorporation or positioning into the garment, especially as pocket 10 is generally not fastened to the garment along inner edge 66 or base edge 44.

Figure 3:
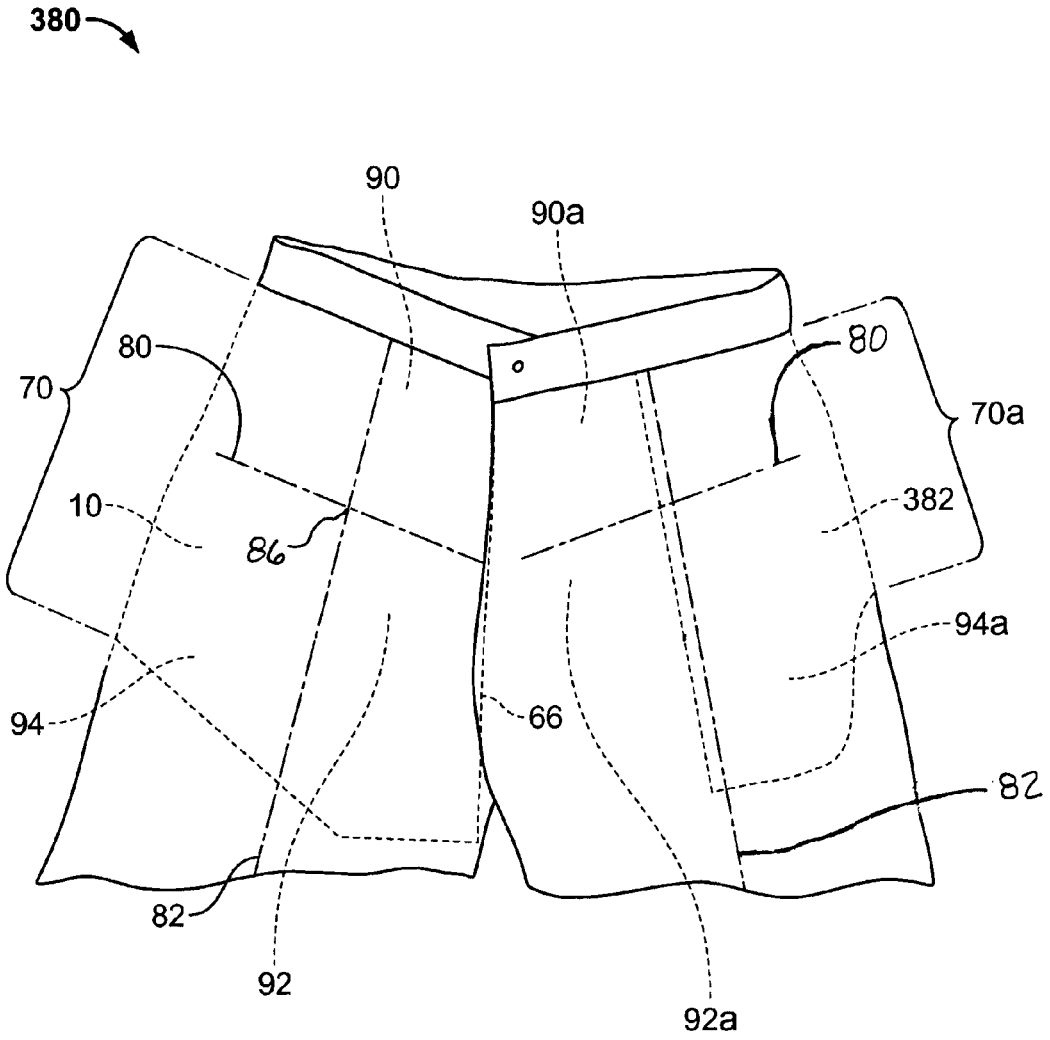
FIG. 3 shows a partial front view of a pair of pants having an exemplary embodiment of a garment pocket.

Pocket 10 can be incorporated or positioned into a garment (e.g., pants) as shown in FIG. 3. In FIGS. 2 and 3, line 80 represents approximately the line of flexion corresponding to the wearer's hip joint. Line 82 represents approximately the centerline of the wearer's thigh. Line 84 (shown in FIG. 2 only) represents approximately the wearer's waistline. Origin point 86 is defined by the intersection of line 80 and line 82.

Assuming that line 80 and line 82 correspond respectively to the x-axis and y-axis of a Cartesian coordinate system, pocket 10 can be considered as having four quadrant-like regions. A first region 90 can be defined by (1) the line of flexion corresponding to the wearer's hip joint (i.e., line 80); (2) the centerline of the wearer's thigh (i.e., line 82); (3) inner edge 66 of pocket 10, which corresponds approximately to the line defined by the wearer's inseam; and (4) line 84, which corresponds approximately to the wearer's waistline. A second region 92 can be defined by (1) the line of flexion corresponding to the wearer's hip joint (i.e., line 80); (2) the centerline of the wearer's thigh (i.e., line 82); (3) inner edge 66 of pocket 10, which corresponds approximately to the line defined by the wearer's inseam; and (4) base edge 44, which is located above the line of flexion corresponding to the wearer's knee joint, and includes first segment 40. A third region 94 can be defined by (1) the line of flexion corresponding to the wearer's hip joint (i.e., line 80); (2) the centerline of the wearer's thigh (i.e., line 82); (3) outer edge 54; and (4) second segment 42 of base edge 44. The fourth region can be defined by (1) the line of flexion corresponding to the wearer's hip joint (i.e., line 80); (2) the centerline of the wearer's thigh (i.e., line 82); (3) outer edge 54; and (4) line 84, which corresponds approximately to the wearer's waistline.

As shown in FIG. 2, pocket 10 can include first seam 102, which is substantially parallel to inner edge 66 and is substantially perpendicular to segment 40 of base edge 44. First seam 102, inner edge 66, and first segment 40 define receiving zone 104, which is configured to receive barrel portion 110, muzzle 112, and trigger guard 114 of handgun 120. Receiving zone 104 (also referred to herein as "partially-enclosed subspace") can be dimensioned to aid in maintaining handgun 120 in second region 92 and to provide an ergonomic orientation of handgun 120. Ergonomic orientation refers to one or more of (1) barrel portion 110 being substantially adjacent to inner edge 66; (2) muzzle 112 being substantially adjacent to first segment 40 of base edge 44; and/or (3) trigger guard 114 being proximal to the end of first seam 102 opposite base edge 44 (i.e., first end 122). Even when a handgun is carried in the ergonomic orientation, the grip of the handgun nevertheless may encroach slightly into third region 94 by intersecting the centerline of the wearer's thigh (line 82). This encroachment by the grip can be more common when a relatively large handgun is carried in the ergonomic orientation. Thus, a handgun, when carried in the ergonomic orientation, is stored (at least) substantially in second region 92. Referring still to FIG. 2, width 130 of receiving zone 104 is defined by the approximate distance between inner edge 66 and first seam 102. First seam 102 and inner edge 66 restrict lateral movement and rotation of handgun 120, and maintain barrel portion 110 in an orientation substantially adjacent to inner edge 66. If width 130 is too great, barrel portion 110 can move and not maintain such adjacent orientation. Conversely, if width 130 is too small, the wearer may experience difficulty in inserting barrel portion 110 and trigger guard 114 into receiving zone 104. In other exemplary embodiments, the ergonomic orientation can be adjusted to accommodate particular preferences of the wearer as discussed with respect to the embodiments shown in FIGS. 20-22.

Length 132 of receiving zone 104 is defined by the approximate length of first seam 102. As shown in FIG. 2, the length of first seam 102 can be selected such that, once handgun 120 is inserted into receiving zone 104, the muzzle 112 of handgun 120 rests on base edge 44 and forms a finger gap 140 between grip 142 of handgun 120 and first end 122 of first seam 102. Finger gap 140 enables the wearer to more readily grip and remove handgun 120 from pocket 10. The wearer, in preparing to remove handgun 120 from pocket 10, does not have to force his fingers between grip 142 and first end 122 of first seam 102 in order to grasp grip 142. Accordingly, finger gap 140 and the length of barrel portion 110 of handgun 120 can be factors in selecting the length of first seam 102.

In one embodiment, pocket 10 could be modified to carry a handgun having an even longer barrel portion than barrel portion 110 of handgun 120 by extending inner edge 66, first seam 102, and base edge 44 downward (i.e., in the direction of the wearer's knee), increasing length 132 of receiving zone 104. However, neither inner edge 66, first seam 102, nor base edge 44 may be extended so far downward that they meet or intersect the line of flexion of corresponding to the wearer's knee joint. Similarly, in another embodiment, pocket 10 could be modified to carry a handgun having a shorter barrel portion than barrel portion 110 of handgun 120 by shortening (1) first seam 102, or (2) first seam 102 and inner edge 66. In a further embodiment, the length of inner edge 66 may be shortened more than first seam 102 is shortened. In other exemplary embodiments, pocket 10 may include additional features that enable a user to properly carry a handgun having a shorter barrel portion, without having to physically shorten first seam 102 or inner edge 66 as discussed with respect to the embodiments shown in FIGS. 9-13C.

FIG. 3 shows a pair of pants 380 incorporating or having pocket 10. Specifically, pocket 10 has been substituted for the conventional right front pocket of pants 380. For purposes of comparison, FIG. 3 includes an approximate outline of a conventional left front pocket 382. As shown by FIG. 3, even a relatively large conventional front pocket, such as left front pocket 382, does not permit a handgun (or other object) to be carried in first region 90*a* or second region 92*a*, which are the respective counterparts to first region 90 and second region 92 of pocket 10, because pocket 382 does not extend into first region 90*a* and/or second region 92*a*. Telegraphing of a handgun (or other object) carried in conventional left front pocket 382 is more likely to occur because, inter alia, the handgun (or other object) would not be retained in first region 90*a* or second region 92*a* where the handgun can be more easily concealed. Instead, the handgun would be retained in third region 94*a*, which is the counterpart to third region 94 of pocket 10. In further contrast to pocket 10, conventional left front pocket 382 does not include any features for maintaining a handgun (or other object) in a position and orientation that facilitates removal by the wearer.

Figure 4:
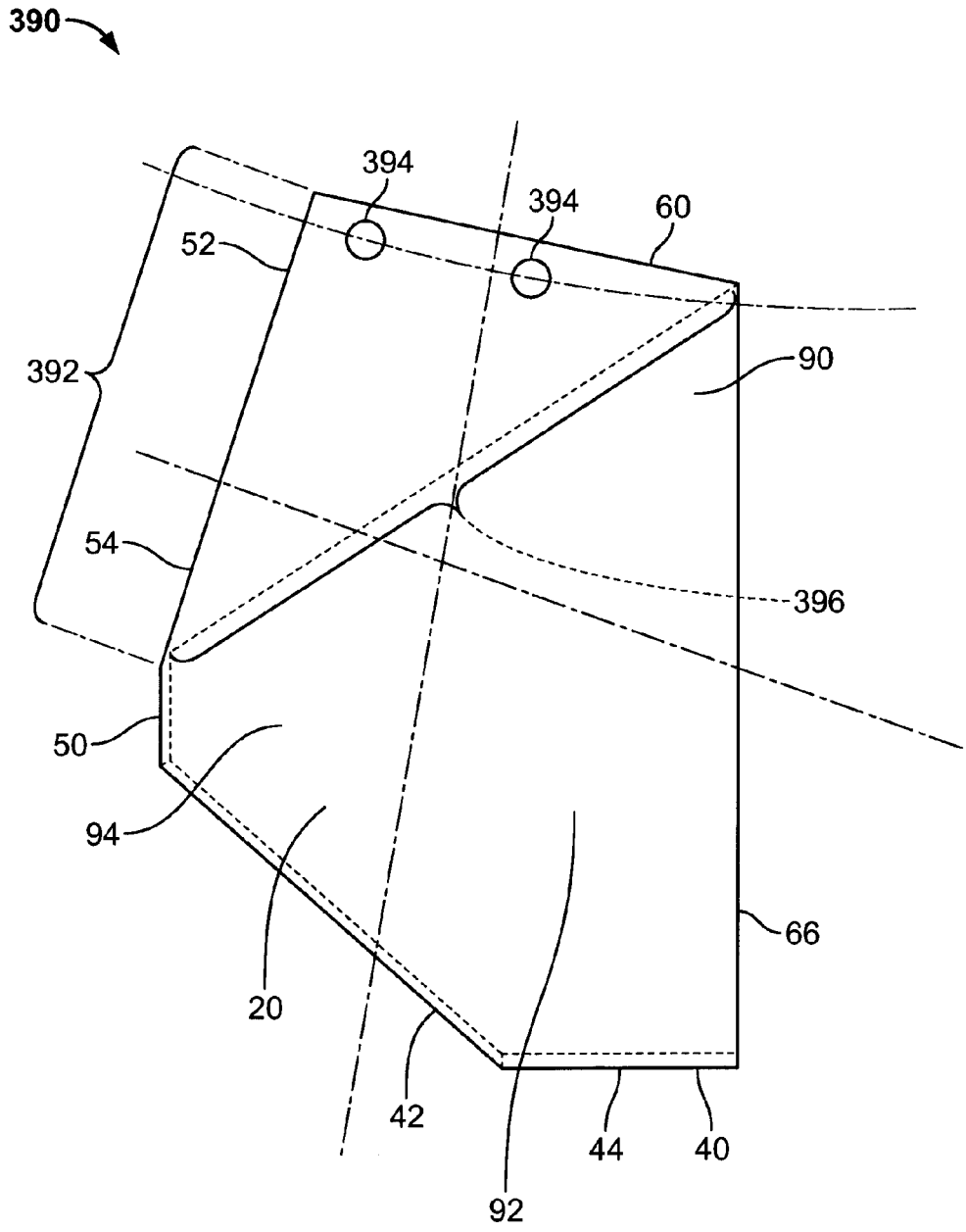
FIG. 4 shows a schematic front plan view of an exemplary embodiment of a garment pocket.

In FIG. 4, pocket 390, which is similar to pocket 10 and configured for access by a wearer's right hand, can be incorporated or positioned into a garment (e.g., pants, shorts, skirts). Similar to pocket 10, pocket 390 can also be configured for access by a wearer's left hand. Pocket 390 can be configured and assembled similar to pocket 10, except that outer part 20 of pocket 390 is not securely fastened to the inner part of pocket along top edge 60. Outer part 20 of pocket 390 can be releasably fastened to the corresponding inner part of pocket 390 along top edge 60 via readily-releasable fasteners 394 that can be disguised or hidden within a flap in the garment that also serves as a waistband. In one embodiment, readily-releasable fasteners 394 are snaps; however, other readily-releasable fasteners, including (without limitation) hook and loop-type fasteners (e.g., Velcro®) may be used instead of, or in combination with, snaps. In another embodiment, outer part 20 can alternatively be releasably fastened to the corresponding inner layer along outer edge 54.

In pocket 390, the corresponding inner part (but not outer part 20) can be fastened to the waistline of the garment along top edge 60. Similarly, the corresponding inner part (but not outer part 20) can be fastened to the garment along segment 52 of outer edge 54, which coincides with an unenlarged pocket opening 392 (explained below). Both outer part 20 and the corresponding inner part are intended to be fastened to the garment along segment 50 of outer edge 54. Outer edge 54 can be used to maintain pocket 390 in a proper position following incorporation into the garment, especially as pocket 390 generally is not fastened to the garment along inner edge 66 or base edge 44.

Pocket 390 is shown with an unenlarged pocket opening 392, which is comparable in size to a conventional pocket opening. The wearer can freely insert his hand into pocket 390 by way of unenlarged pocket opening 392 and grip an exemplary object (e.g., handgun, passport) carried in receiving zone 104. However, removal of the exemplary object from pocket 390 by way of unenlarged pocket opening 392 can be impeded because the size of the wearer's hand, when gripping the object, may be greater than the size of the unenlarged pocket opening 392. Upon the release of readily-releasable fasteners 394, the opening of pocket 390 becomes an enlarged pocket opening 396. Enlarged pocket opening 396 is significantly larger than unenlarged pocket opening 392. Enlarged pocket opening 396 is dimensioned such that the wearer can readily remove an object from pocket 390 because the size of enlarged pocket opening 396 is significantly greater than the size of the wearer's hand gripping the object. Aside from the presence of enlarged pocket opening 396 and the attendant modifications, pocket 390 is otherwise similar to pocket 10.

Figure 5:
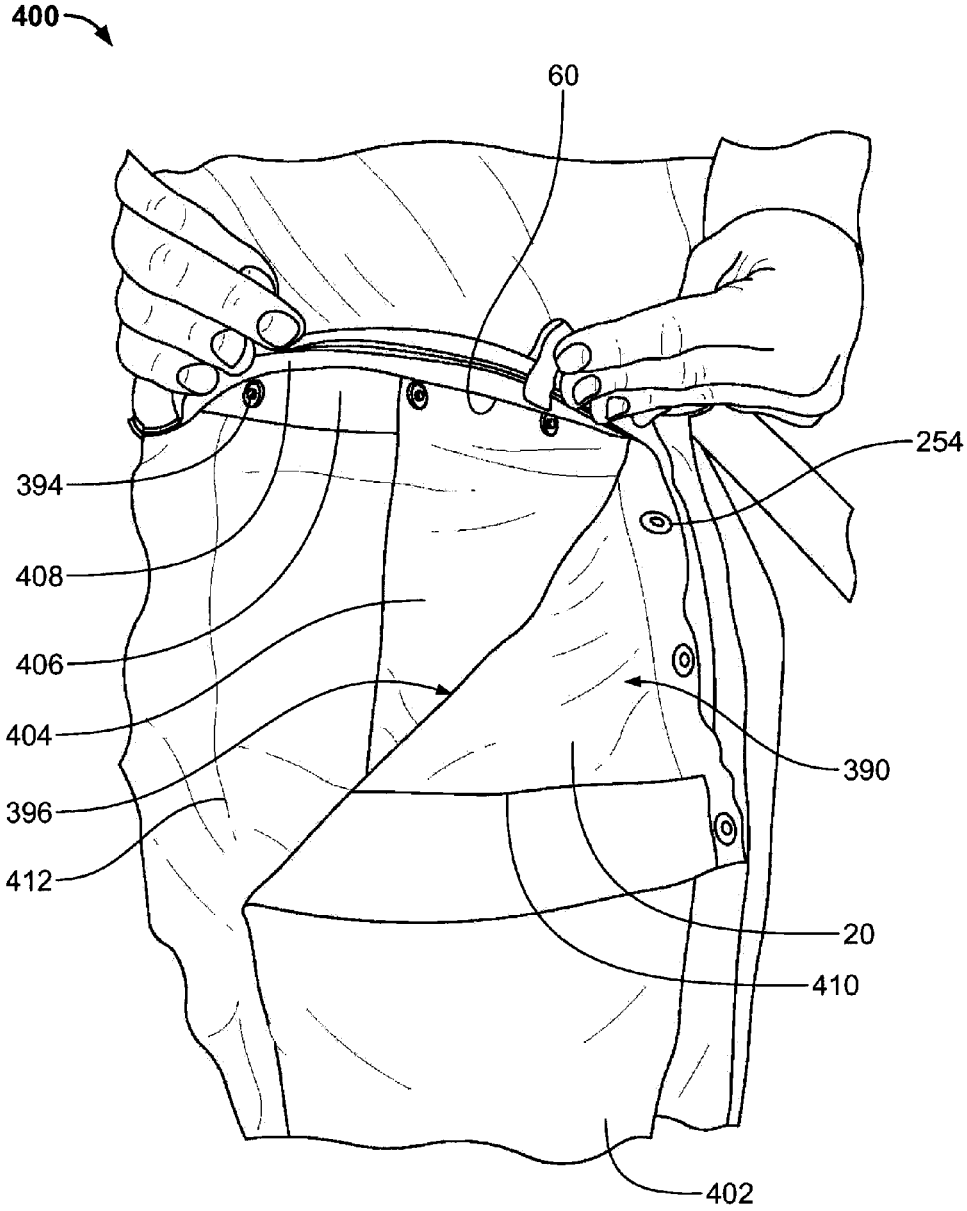
FIG. 5 shows a side view of an exemplary embodiment of a garment pocket incorporated in a garment such as pants.

In FIG. 5, a wearer 400 has pants 402 that include pocket 390. The opening of pocket 390 is shown in its enlarged state, i.e., enlarged pocket opening 396, as readily-releasable fasteners 394 are not fastened. Enlarged pocket opening 396 is dimensioned such that wearer 400 can readily remove an object (e.g., handgun, passport) from pocket 390. FIG. 5 also shows the relationship between inner layer 404 and outer part 20. The pre-existing seams of pants 402 can be used when incorporating or positioning pocket 390, to minimize the possibility that an observer may notice that pants 402 have been modified. For example, top edge 60 of inner layer 404 is fastened (e.g., seamed) along waistline 406 of pants 402, beneath beltline 408. When fastened, fasteners 394 are concealed by beltline 408, hiding the presence of a pocket opening that is enlargeable (see enlarged pocket opening 396). Additionally, there is no requirement that inner layer 404 and outer part 20 be congruent. As shown in FIG. 5, side edge 410 of outer part 20 extends further toward side seam 412 of pants 402 than does inner layer 404.

Figure 6A:
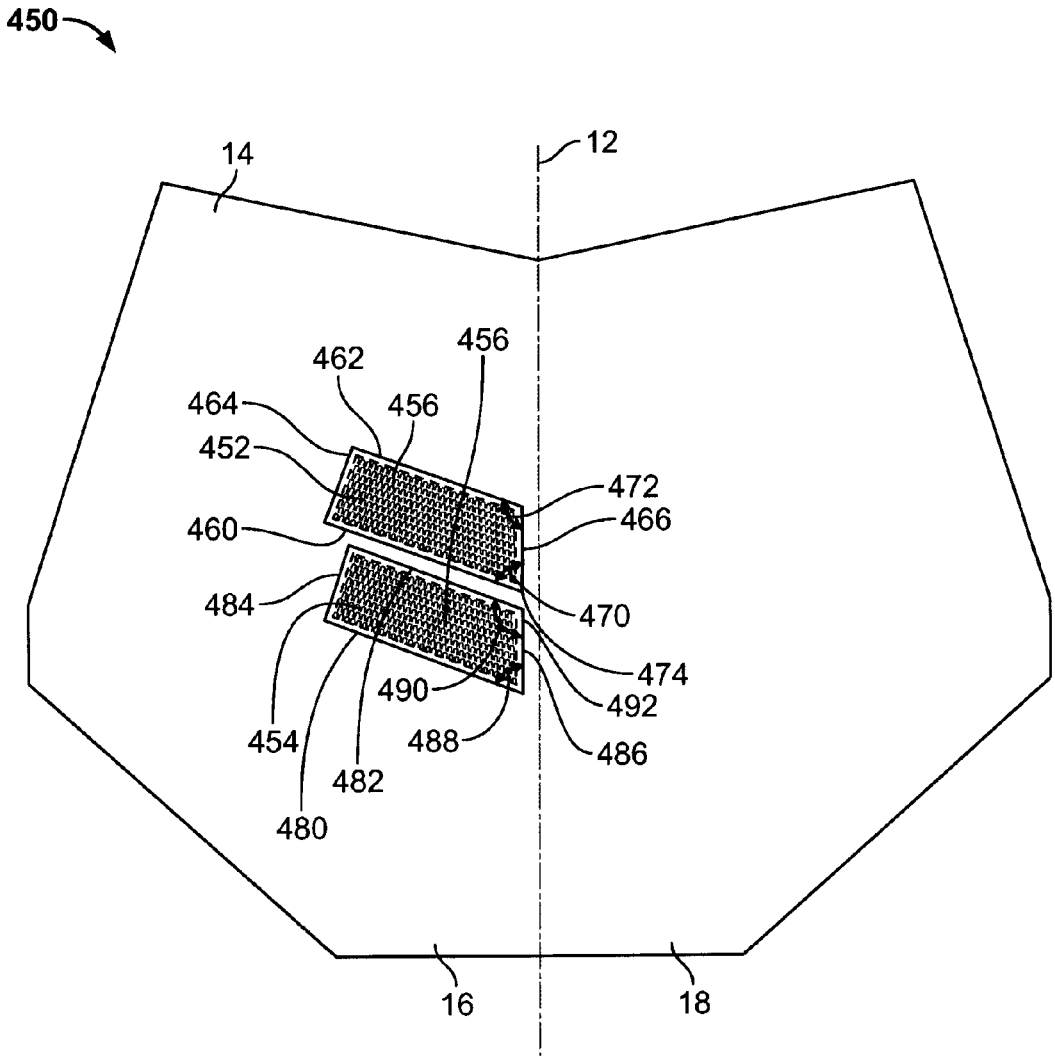
FIG. 6A shows a front plan view of an exemplary embodiment of an unsewn garment pocket.
Figure 6B:
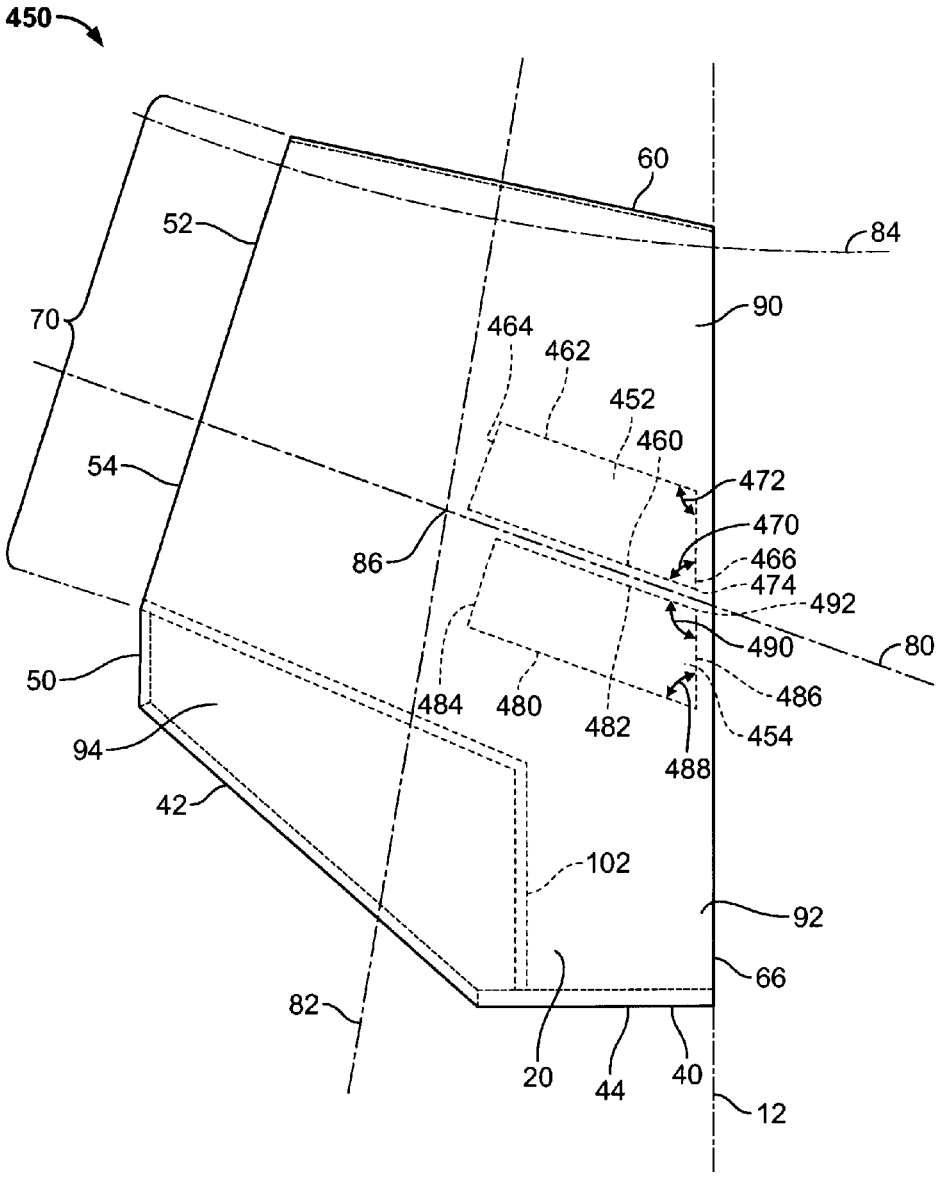
FIG. 6B shows a front plan view of an exemplary embodiment of a sewn garment pocket.

In FIGS. 6A and 6B, pocket 450 is substantially similar to pocket 10 but has additional features that can aid the wearer in carrying, in a concealed and readily-accessible state, an extra handgun magazine or other relatively small object (e.g., ammunition, pepper spray, pocket tool, handcuffs, dagger, etc.) in addition to the handgun or other object carried in receiving zone 104. A first interior surface of pocket 450 includes a first attachment zone 452 and a second attachment zone 454. First attachment zone 452 and a retainer 510 (see e.g., FIGS. 7A, 7C, and 7D) are mutually configured to enable retainer 510 to be releasably attached, removed and reattached multiple times to the first interior surface of pocket 450. In another embodiment, first attachment zone 452 can be included on the opposing second interior surface. As shown in FIG. 6A, first attachment zone 452 includes loop-type fasteners 456 to enable releasable attachment to retainer 510, by way of corresponding hook-type fasteners 534 on retainer 510 (see e.g., FIG. 7D). Hook and loop-type fastener systems marketed under the trademark Velcro® are among those that are suitable for use in this application. Other readily-releasable fastener systems, including (without limitation) snaps or adhesives, may be used instead of, or in combination with, hook and loop-type fastener systems. In this exemplary embodiment, loop-type fasteners 456, as opposed to hook-type fasteners 534, are present on first attachment zone 452 because loop-type fasteners are generally less abrasive than hook-type fasteners. Thus, when pocket 450 is being used without retainer 510, the wearer may experience less discomfort from contact with loop-type fasteners 456 when inserting (or withdrawing) a hand in (or from) pocket 450. In an alternate embodiment, hook-type fasteners can be used on first attachment zone 452 and loop-type fasteners can be used on retainer 510. Alternatively, a non-hook and loop-type fastener system (e.g., snaps) may be used in first attachment zone 452 and retainer 510.

Second attachment zone 454 and retainer 510 (see e.g., FIGS. 8A and 8B) can be mutually configured to enable retainer 510 to be releasably attached, removed, and reattached to the first interior surface of pocket 450. The structure and function of second attachment zone 454 is similar to the structure and function of first attachment zone 452, and the variations in structure described above in relation to first attachment zone 452 are equally applicable to second attachment zone 454. In the exemplary embodiment shown in FIGS. 6A and 6B, first attachment zone 452 is substantially identical in size to second attachment zone 454. However, in other embodiments, first attachment zone 452 and second attachment zone 454 may have different sizes. The exemplary embodiment shown in FIGS. 6A and 6B can be configured to enable the releasable attachment of two retainers 510, each of which is configured to retain therein a handgun magazine, such as that shown in FIG. 7B, or other item. In other exemplary embodiments, pocket 450 can include one attachment zone or three or more attachment zones.

First attachment zone 452 can be located in first region 90 of pocket 450 (see FIG. 6B). First attachment zone 452 can be located adjacent to line 80, which corresponds to the line of flexion corresponding to the wearer's hip joint, and adjacent to inner edge 66, which corresponds approximately to the line defined by the wearer's inseam. In other embodiments, first attachment zone 452 may be located elsewhere in first region 90, provided first attachment zone 452 does not substantially intersect line 80 or line 82. Also, as shown in FIGS. 6A and 6B, the shape of first attachment zone 452 is a right-angled trapezoid, rendering first attachment zone 452 substantially congruent to retainer 510 shown in FIGS. 7A, 7C, and 7D, thereby providing guidance to the wearer as he seeks to mate hook-type fasteners 534 of retainer 510 with loop-type fasteners 456 of first attachment zone 452 and fix retainer 510 in proper position and orientation in first region 90. In other embodiments, first attachment zone 452 and retainer 510 are not substantially congruent, such as when the retainer 510 is configured in the embodiment shown in FIGS. 8A and 8B, but still have the requisite and respective fastening (or mating) portions to enable releasable attachment, removal and reattachment multiple times.

In one embodiment, first attachment zone 452 can have two substantially parallel sides: first parallel side 460 and second parallel side 462. Additionally, first attachment zone 452 has a perpendicular side 464, which is perpendicular to first parallel side 460 and to second parallel side 462, and a non-perpendicular side 466. First parallel side 460 and non-perpendicular side 466 meet at an acute angle 470, and second parallel side 462 and non-perpendicular side 466 meet at an obtuse angle 472. First attachment zone 452 is oriented such that non-perpendicular side 466 is substantially parallel to inner edge 66, and first parallel side 460 is substantially parallel to line 80. Additionally, first attachment zone 452 is oriented such that vertex 474 of acute angle 470 is proximate to the intersection of line 80 and inner edge 66. In the exemplary embodiment, acute angle 470 is approximately seventy degrees (70°). An acute angle 470 of approximately seventy degrees (70°) aligns retainer 510, such that retainer opening 524 is directed toward pocket opening 70, thereby facilitating removal, by the wearer, of the object (e.g., handgun magazine) retained in retainer 510. Depending on the intended use and/or the location of first attachment zone 452 in first region 90, however, acute angle 470 may range from approximately forty-five degrees) (45°) to approximately eighty-five degrees (85°) and, more preferably, from approximately sixty degrees (60°) to approximately eighty degrees (80°). Acute angle 470 may also vary with the configuration of pocket opening 70.

Second attachment zone 454 can be located in second region 92 of pocket 450. Second attachment zone 454 can be located adjacent to line 80, which corresponds to the line of flexion corresponding to the wearer's hip joint, and adjacent to inner edge 66, which corresponds approximately to the line defined by the wearer's inseam. In other embodiments, second attachment zone 454 may be located elsewhere in second region 92, provided second attachment zone 454 does not substantially intersect line 80 or line 82 or interfere with the insertion or removal of an object from receiving zone 104. In an exemplary embodiment, the shape of second attachment zone 454 is a right-angled trapezoid, rendering second attachment zone 454 substantially congruent to first attachment zone 452 and retainer 510 shown in FIGS. 7A, 7C and 7D, thereby providing guidance to the wearer as he seeks to mate hook-type fasteners 534 of retainer 510 with loop-type fasteners 456 of second attachment zone 454 to fix retainer 510 in the proper position and orientation in second region 92. In other embodiments, second attachment zone 454 and retainer 510 may not be substantially congruent, such as when the retainer 510 is configured in the embodiment shown in FIGS. 8A and 8B, but still have the requisite and respective fastening (or mating) portions to enable releasable attachment, removal and reattachment multiple times. Second attachment zone 454 has two substantially parallel sides: first parallel side 480 and second parallel side 482. Additionally, second attachment zone 454 has a perpendicular side 484, which is perpendicular to first parallel side 480 and to second parallel side 482, and a non-perpendicular side 486. First parallel side 480 and non-perpendicular side 486 meet at an acute angle 488, and second parallel side 482 and non-perpendicular side 486 meet at an obtuse angle 490. Second attachment zone 454 is oriented such that non-perpendicular side 486 is substantially parallel to inner edge 66, and second parallel side 482 is substantially parallel to line 80. Additionally, second attachment zone 454 is oriented such that vertex 492 of obtuse angle 490 is proximate to the intersection of line 80 and inner edge 66.

In other embodiments, the shapes of first and/or second attachment zones 452, 454 can vary depending on the intended use. For example, first and/or second attachment zones 452, 454 can have a circular, semicircular, or elliptical shape for use in carrying handcuffs. Similarly, first and/or second attachment zones 452, 454 can have a triangular shape for use in carrying a dagger. Variation in the application generally results also in an analogous change in the shape of retainer 510.

In an exemplary embodiment, obtuse angle 490 is approximately one-hundred-ten degrees (110°). An obtuse angle 490 of approximately one hundred ten degrees (110°) aligns retainer 510 such that retainer opening 526 is directed toward pocket opening 70, thereby facilitating removal by the wearer of the object (e.g., handgun magazine) retained in retainer 510. Depending on the application and/or the location of second attachment zone 454 in second region 92, however, obtuse angle 490 may range from approximately ninety-five degrees (95°) to approximately one-hundred-thirty-five degrees (135°) and, more preferably, from approximately one hundred degrees (100°) to approximately one-hundred-twenty degrees (120°). Obtuse angle 490 may also vary with the configuration of pocket opening 70. In one embodiment, acute angle 470 of first attachment zone 452 can be supplementary to obtuse angle 490 of second attachment zone 454, as shown in the exemplary embodiment. Accordingly, any retainers 510 attached respectively to first attachment zone 452 and second attachment zone 454 will be similarly oriented toward pocket opening 70.

Figure 7A:
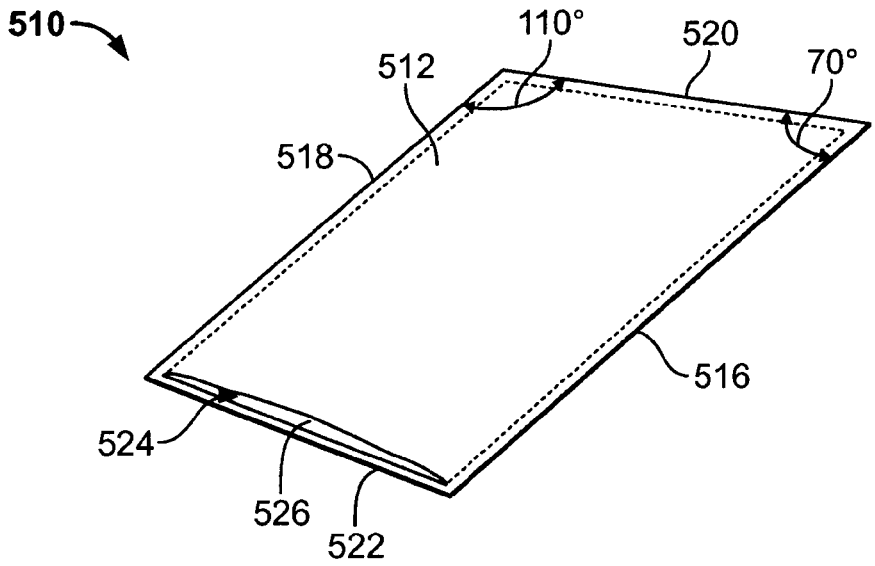
FIG. 7A shows a top perspective view of an exemplary retainer for use with the garment pocket shown in FIGS. 6A and 6B.
Figure 7B:
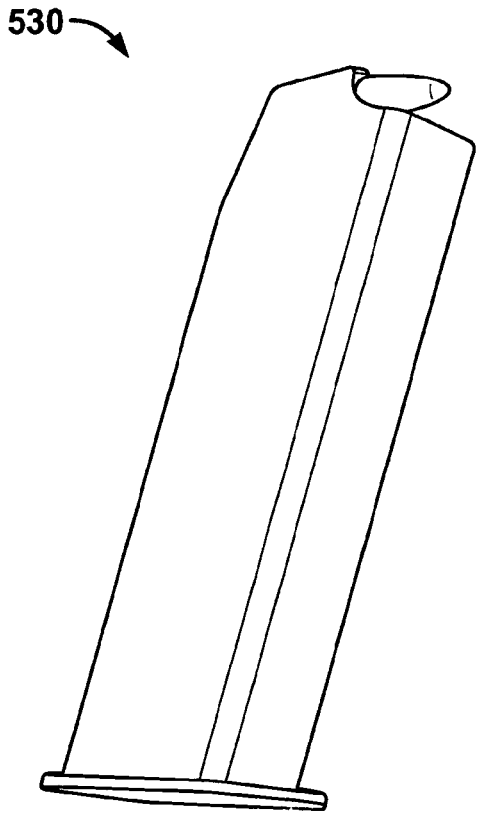
FIG. 7B shows a perspective view of an exemplary handgun magazine.

FIGS. 7A-7D and 8A and 8B illustrate the structure and function of exemplary retainers. The retainer 510 shown in FIGS. 7A, 7C and 7D can have a substantially trapezoidal shape, while the retainer 510 shown in FIGS. 8A and 8B can have a substantially rectangular shape. FIG. 7A is a top perspective view of a retainer 510 for use with the embodiment of pocket 450 shown in FIGS. 6A and 6B. More specifically, retainer 510 is suitable for attachment to either first attachment zone 452 or second attachment zone 454. Retainer 510 includes a first layer 512 and a second layer 514 (see FIGS. 7D and 8B). First layer 512 is fastened (e.g., seamed or sewn) to second layer 514 along first parallel side 516 and second parallel side 518, and (optionally) along non-perpendicular side 520 (if trapezoidally shaped) or along a perpendicular side (if rectangularly shaped). First layer 512 is not fastened to second layer 514 along perpendicular side 522 in order to form a retainer opening 524 along perpendicular side 522, which provides access to a partially enclosed space 526 located between first layer 512 and second layer 514. Retainer 510 is configured to receive in partially enclosed space 526 at least a portion of a handgun magazine, for example, the exemplary nine millimeter (9 mm) handgun magazine 530 shown in FIG. 7B.

Figure 7C:
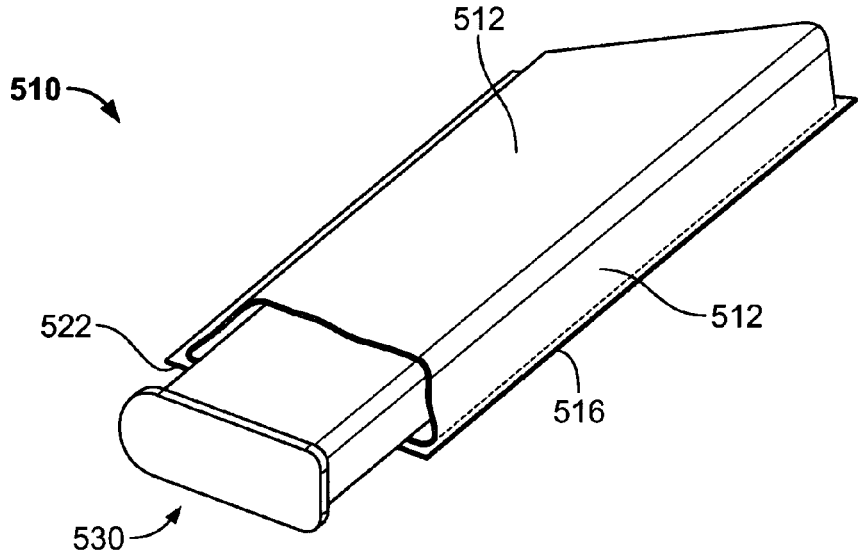
FIGS. 7C-7D show top and bottom perspective views of the exemplary retainer shown in FIG. 7A retaining therein the exemplary handgun magazine shown in FIG. 7B.
Figure 8A:
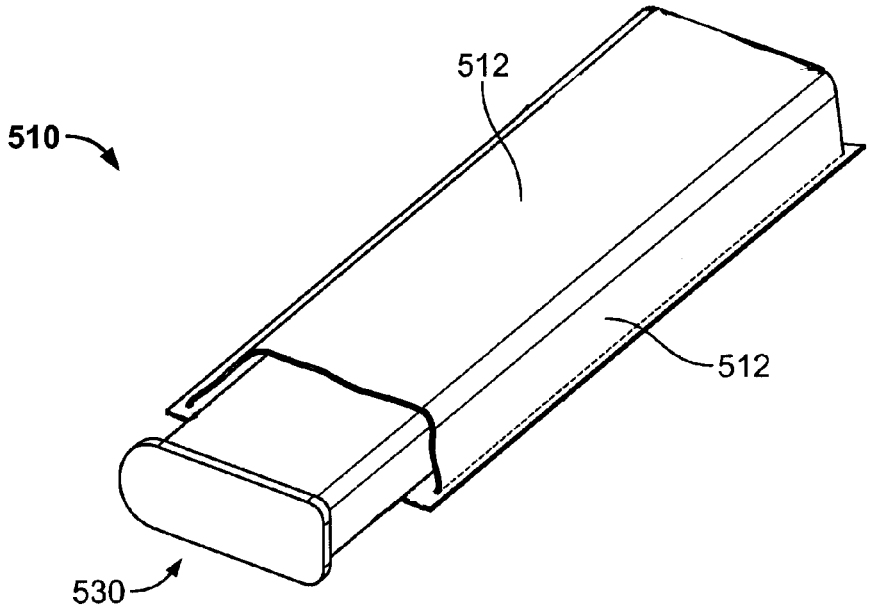
FIGS. 8A-8B show top and bottom perspective views of another exemplary embodiment of a retainer retaining therein the exemplary handgun magazine shown in FIG. 7B.

First layer 512 of exemplary retainer 510 can incorporate an elastic fiber (e.g., spandex, Lycra®) and, therefore, is elastic. Accordingly, as handgun magazine 530 is inserted in retainer 510 by way of retainer opening 524, first layer 512 expands in response to the contact force being exerted thereon by handgun magazine 530. Thus, the volume of partially-enclosed space 526 increases, enabling retainer 510 to retain at least a portion of handgun magazine 530 in position in partially-enclosed space 526. In an expanded state, first layer 512, which is elastic, exerts a compressive force on handgun magazine 530 to aid in retaining the magazine in retainer 510. FIGS. 7C and 8A, which show a top perspective view of handgun magazine 530 retained in retainer 510, show first layer 512 in an expanded state.

Figure 7D:
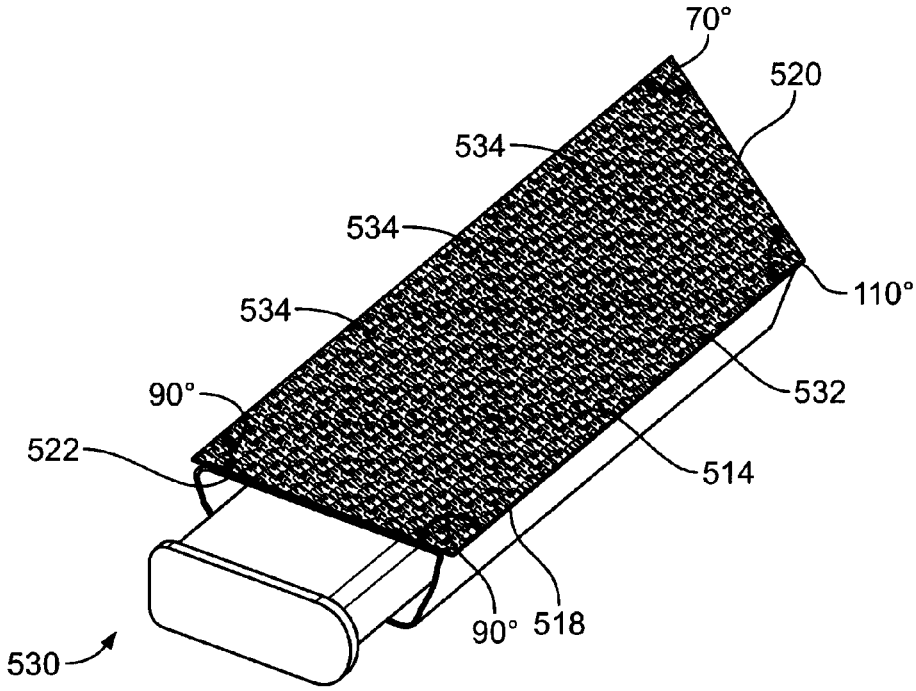
Figure 8B:
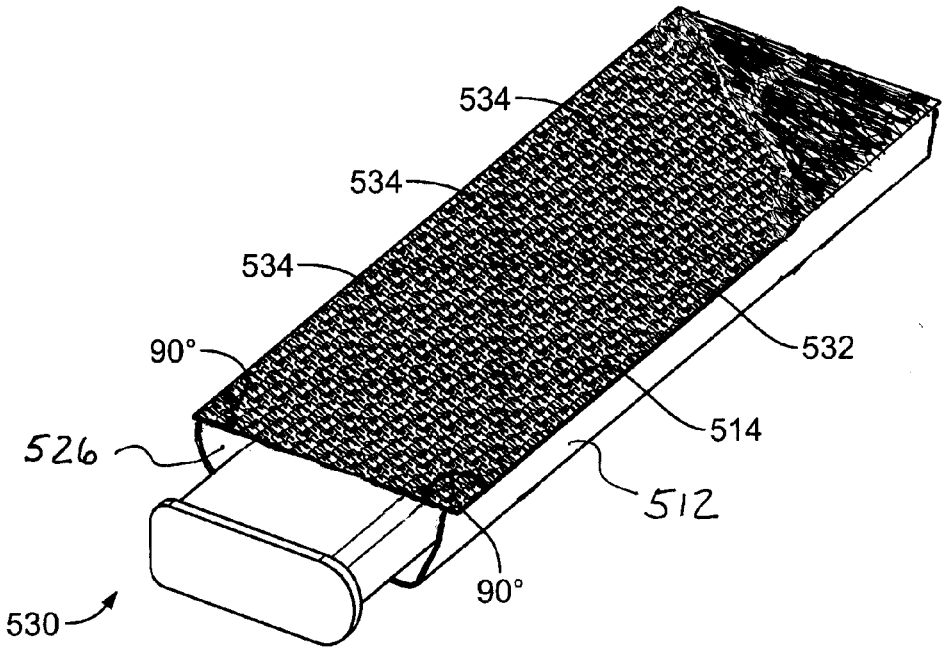

Second layer 514 is shown in FIGS. 7D and 8B, which is a bottom perspective view of handgun magazine 530 retained in retainer 510. Second layer 514 includes an exterior surface 532 that includes a plurality of hook-type fasteners 534, which enable retainer 510 to be releasably attached to either first attachment zone 452 or second attachment zone 454. In one embodiment, second layer 514 can include multiple layers fastened together such as the material of first layer 512 and the material with the plurality of hook-type fasteners 534. In another embodiment, the second layer 514 can include a single layer of the material with the plurality of hook-type fasteners 534.

In another exemplary embodiment, loop-type fasteners may be used on exterior surface 532, provided that hook-type fasteners are present in first attachment zone 452, second attachment zone 454, or both. Alternatively, a non-hook and loop-type fastener system (e.g., snaps, adhesives) may be used between or among retainer(s) 510, first attachment zone 452, and/or second attachment zone 454. In still another embodiment, first layer 512 can be fastened (e.g., seamed or sewn) directly to either inner part (e.g., inner layer 404 (see FIG. 5)) or outer layer 20 to form the retainer or retaining device, thus eliminating second layer 514 and the loop-type fasteners in first attachment zone 452, second attachment zone 454 or both. In this embodiment, the retainer or retaining device is consequently permanently attached to the pocket and, accordingly, is not releasably attached thereto.

In still other embodiments, the area of first attachment zone 452 or second attachment zone 454, respectively, can be increased (or otherwise configured) to enable the attachment of two or more retainers 510 thereto, or to provide the wearer additional options in locating and/or orienting a (single) retainer 510 within first attachment zone 452 or second attachment zone 454, respectively. In some of these embodiments and in still other embodiments, first attachment zone 452 (or second attachment zone 454) may partially extend into second region 92 (or first region 90) and/or third region 94 and/or fourth region (the remaining quadrant). In another embodiment, the features of pocket 450 may be combined with the features of pocket 390 (see FIGS. 4 and 5), i.e., pocket 450 may include a pocket opening that is configured to be adjustable from a first size to a second size, the second size of the opening being larger than the first size of the opening. In still another embodiment, the features of features of pocket 450 may be combined with (1) the features of pocket 390, (2) anti-telegraphing devices, trigger shields and related attendant features, and (3) an adjustable receiving zone 104 and related features.

Figure 9:
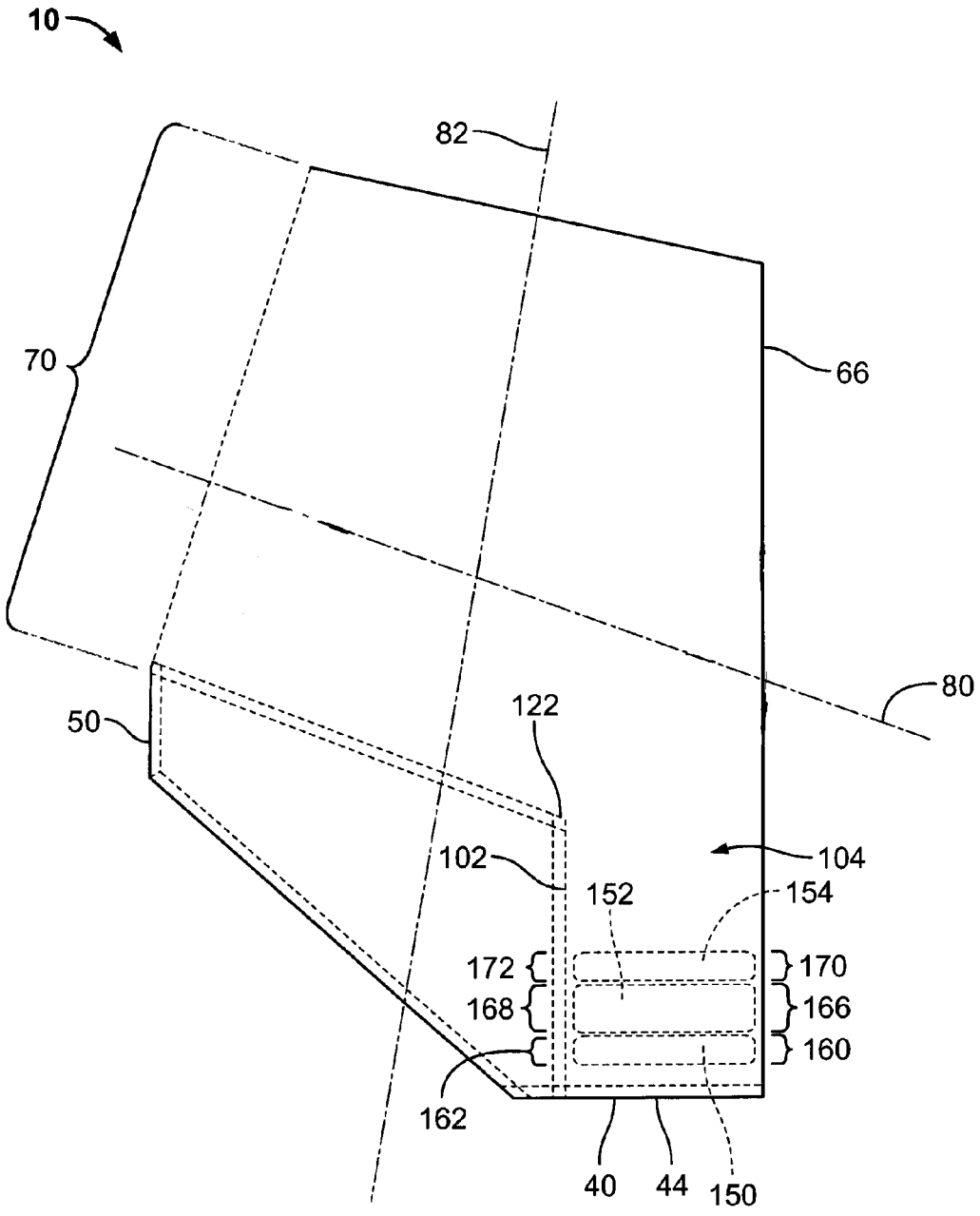
FIGS. 9 and 10 show front plan views of exemplary embodiments of a sewn garment pocket.

In one exemplary embodiment, receiving zone 104 can be adjustably configured to accommodate barrel portions of different lengths. Referring to FIG. 9, receiving zone 104 can be described as including three non-overlapping quadrilateral sub-regions: a first receiving-zone sub-region 150, a second receiving-zone sub-region 152, and a third receiving-zone sub-region 154. Each of these sub-regions 150, 152, 154 may be defined, in part, by a respective portion of inner edge 66 and a respective opposing portion of first seam 102. More particularly, first receiving-zone sub-region 150 may be defined in part by a first portion 160 of inner edge 66 and a first opposing portion 162 of first seam 102. Second receiving-zone sub-region 152 may be defined in part by a second portion 166 of inner edge 66 and a second opposing portion 168 of first seam 102. Third receiving-zone sub-region may be defined in part by a third portion 170 of inner edge 66 and a third opposing portion 172 of first seam 102. Receiving-zone sub-regions 150, 152, 154 vary respectively in proximity to first segment 40 of base edge 44. More specifically, first receiving-zone sub-region 150 is more proximate to first segment 40 than either second receiving-zone sub-region 152 or third receiving-zone sub-region 154. Second receiving-zone sub-region 152 is more proximate to first segment 40 than third receiving-zone sub-region 154.

Figure 10:
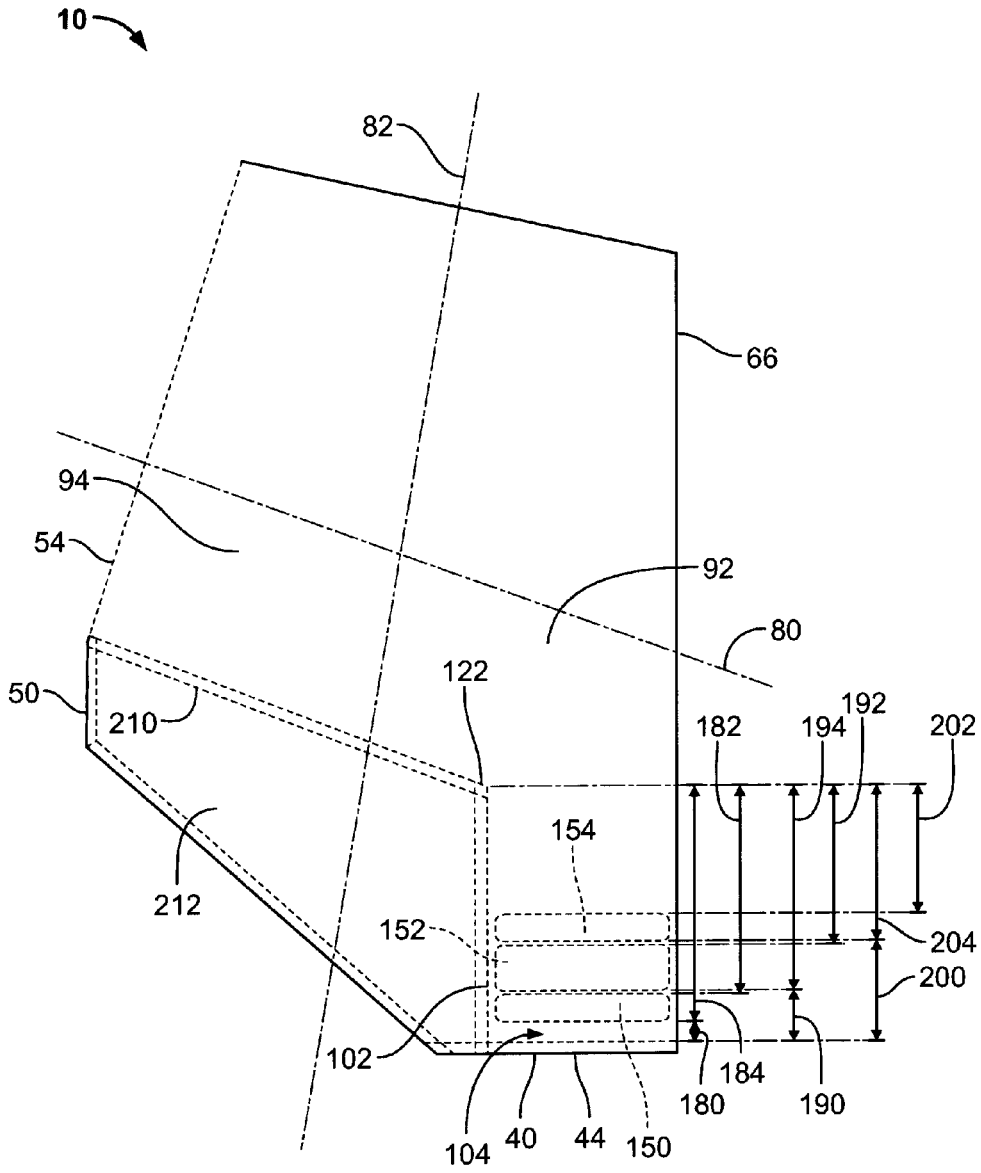
Figure 11A:
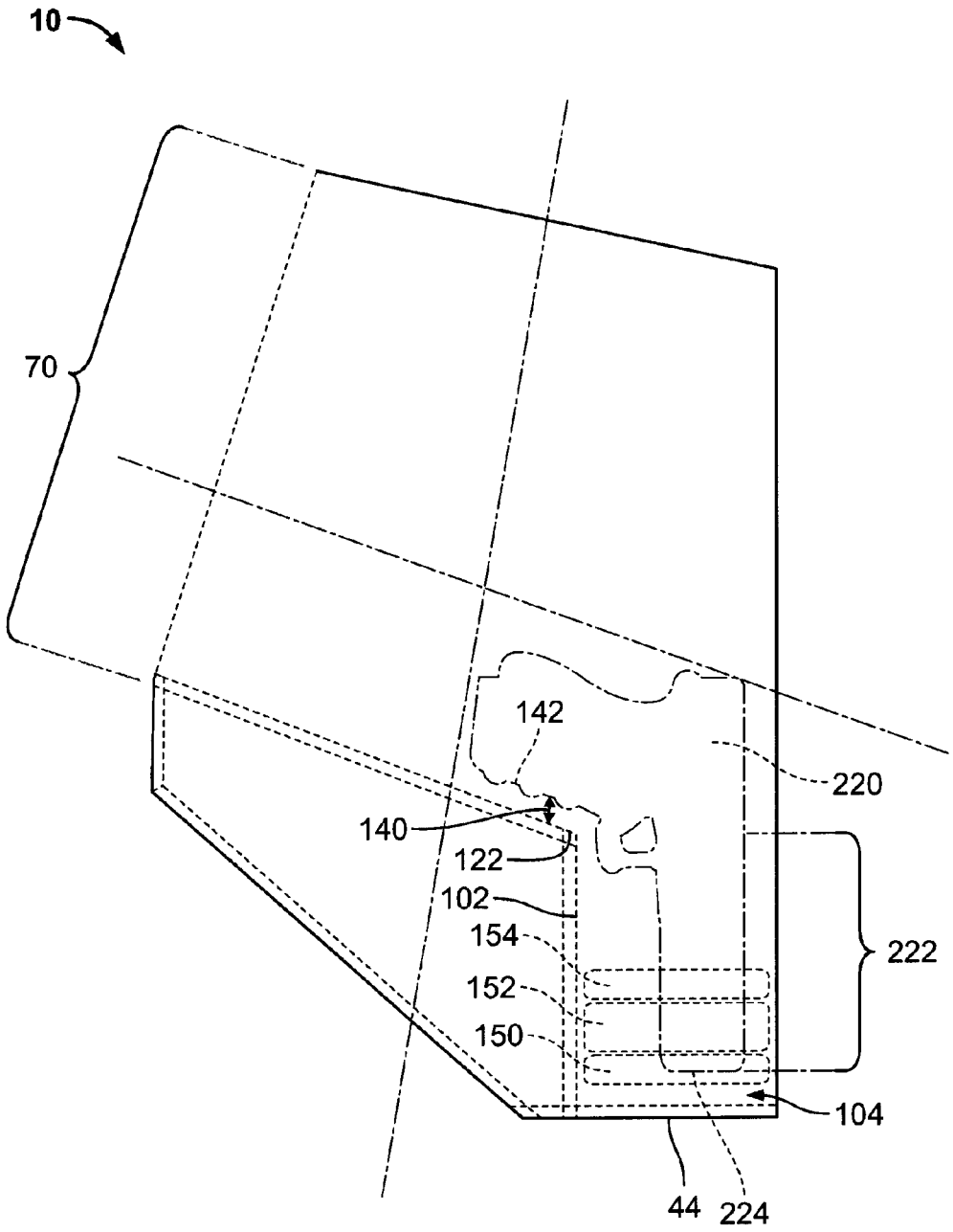
FIGS. 11A-11C show front plan views of an exemplary embodiment of a sewn garment pocket carrying handguns of varying barrel length.

As shown in FIG. 10, the proximity of first receiving-zone sub-region 150 to first segment 40 is quantifiable by measuring a length 180, which represents the distance between first receiving-zone sub-region 150 and base edge 44. A barrel-portion range of first receiving-zone sub-region 150 is quantifiable by measuring a length 182, which represents the lower end of the range, and by measuring a length 184, which represents the upper end of the range. Referring to FIG. 11A, the barrel-portion range of first receiving-zone sub-region 150 and the proximity of first receiving-zone sub-region 150 to first segment 40 are selected such that at least one condition can be satisfied when a handgun 220 having a barrel portion 222 (which is shorter than the long barrel portion 110 of handgun 120 shown in FIG. 2) is carried in pocket 10. Specifically, muzzle 224 of handgun 220 can be present in first receiving-zone sub-region 150, i.e., barrel portion 232 terminates in first receiving-zone sub-region 150. In another embodiment, the following optional condition can be satisfied when finger gap 140 is present between grip 142 and first end 122 of first seam 102.

Figure 11B:
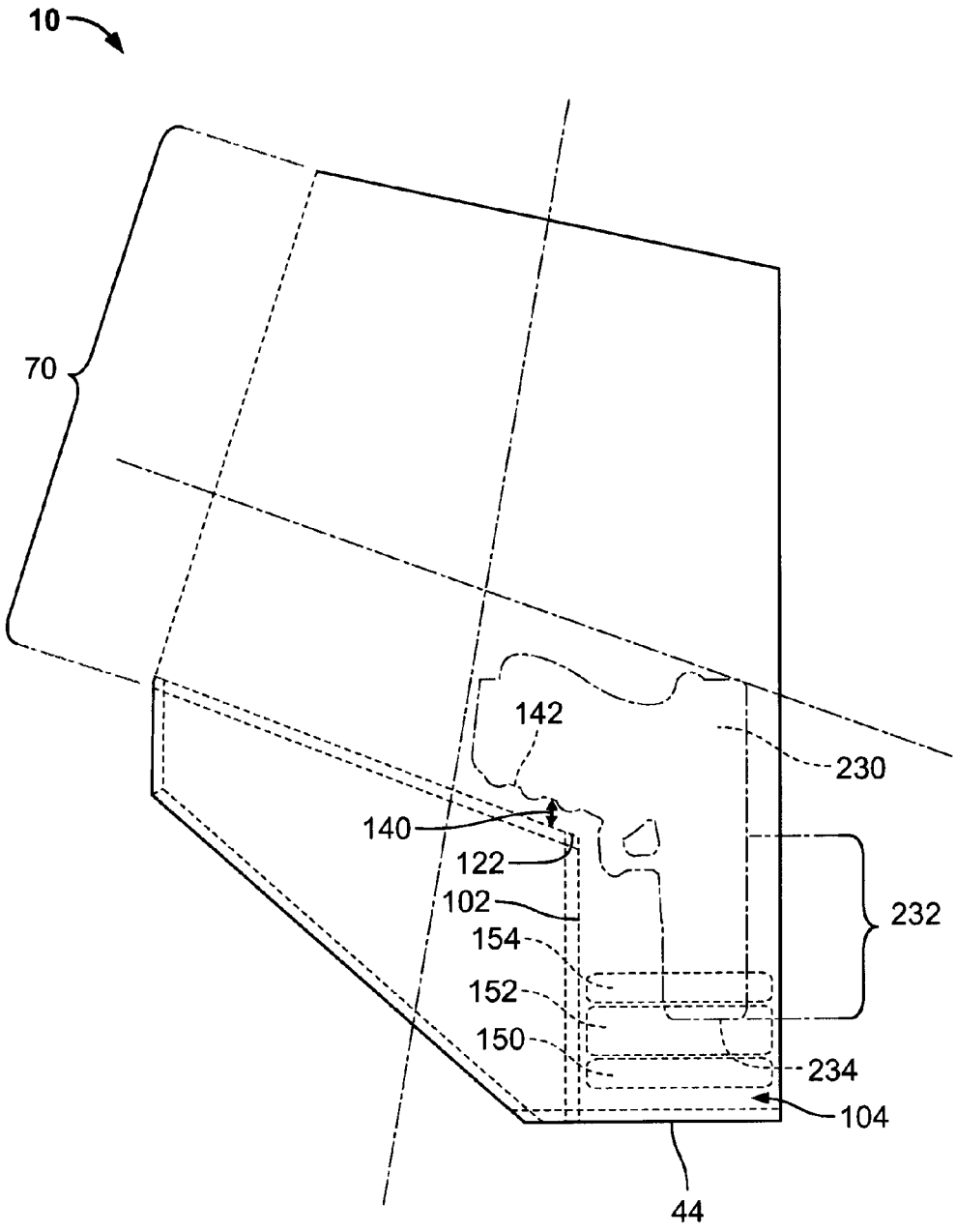

Similarly, as shown in FIG. 10, the proximity of second receiving-zone sub-region 152 to first segment 40 is quantifiable by measuring a length 190, which represents the distance between second receiving-zone sub-region 152 and base edge 44. A barrel-portion range of second receiving-zone sub-region 152 is quantifiable by measuring a length 192, which represents the lower end of the range, and by measuring a length 194, which represents the upper end of the range. Referring to FIG. 11B, the barrel-portion range of second receiving-zone sub-region 152 and the proximity of second receiving-zone sub-region 152 to first segment 40 are selected such that at least one condition is satisfied when a handgun 230 having a medium-length barrel portion 232 (which is shorter than the barrel portion 222 of handgun 220 shown in FIG. 11A) is carried in pocket 10. Specifically, muzzle 234 of handgun 230 can be present in second receiving-zone sub-region 152, i.e., medium-length barrel portion 232 terminates in second receiving-zone sub-region 152. In another embodiment, the following optional condition can be satisfied when finger gap 140 is present between grip 142 and first end 122 of first seam 102.

Figure 11C:
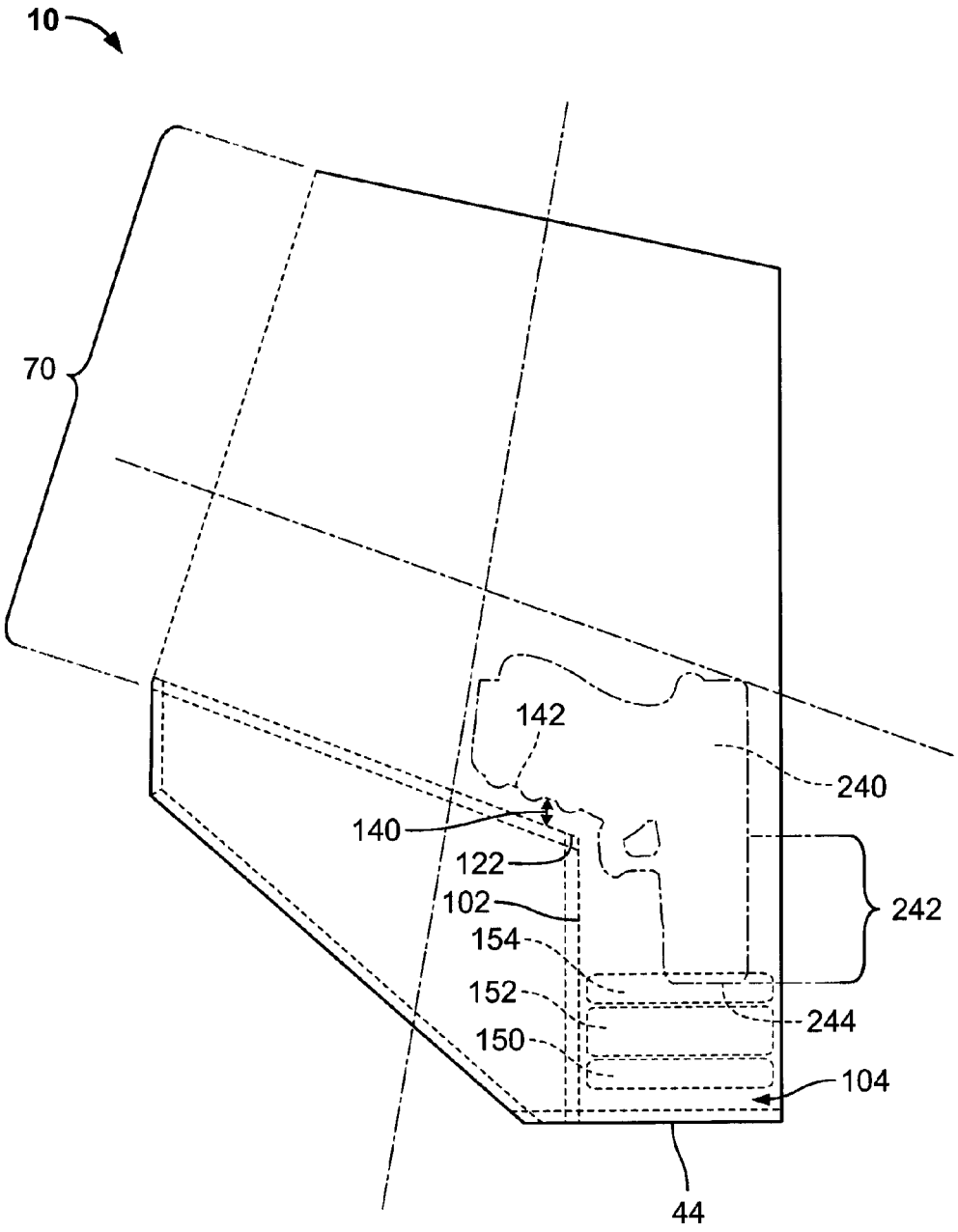

Referring to FIG. 10, the proximity of third receiving-zone sub-region 154 to first segment 40 is quantifiable by measuring a length 200, which represents the distance between third receiving-zone sub-region 154 and base edge 44. A barrel-portion range of third receiving-zone sub-region 154 is quantifiable by measuring a length 202, which represents the lower end of the range, and by measuring a length 204, which represents the upper end of the range. Referring to FIG. 11C, the barrel-portion range of third receiving-zone sub-region 154 and the proximity of third receiving-zone sub-region 154 to first segment 40 are selected such that at least one condition can be satisfied when a handgun 240 having a relatively short barrel portion 242 (which is shorter than the medium-length barrel portion 232 of handgun 230 shown in FIG. 11B) is carried in pocket 10. Specifically, muzzle 244 of handgun 240 can be present in third receiving-zone sub-region 154, i.e., relatively short barrel portion 242 terminates in third receiving-zone sub-region 154. In another embodiment, the following optional condition can be satisfied when finger gap 140 is present between grip 142 and first end 122 of first seam 102.

Referring to FIG. 10, pocket 10 also includes second seam 210, which meets first end 122 of first seam 102 and segment 50 of outer edge 54. Second seam 210 can be provided to seal off adjoining zone 212, which includes part of second region 92 and part of third region 94. Second seam 210 can be configured to aid the wearer in correctly inserting a barrel portion of a handgun into receiving zone 104 by preventing the wearer from mistakenly inserting the barrel portion into adjoining zone 212.

Figure 12:
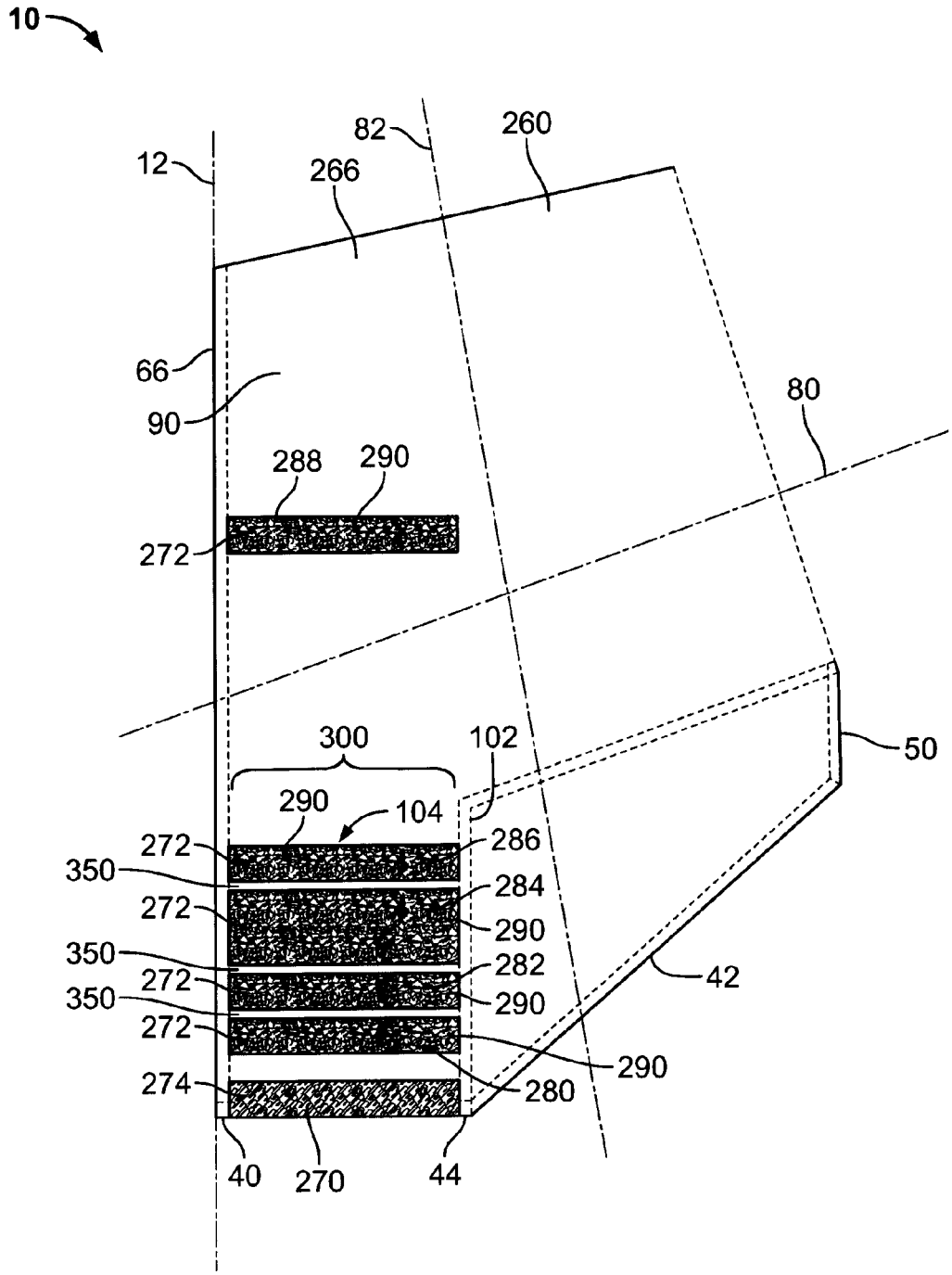
FIG. 12 shows a rear plan view of an exemplary embodiment of a sewn garment pocket.

The muzzles of the handguns shown in FIGS. 11A-11C, unlike muzzle 112 of handgun 120 shown in FIG. 2, do not contact base edge 44 because their barrel portions are shorter. Absent contact with base edge 44, a handgun may not be properly supported within pocket 10 and, consequently, may not be carried in an ergonomic orientation. Referring to FIG. 12, exterior surface 266 of pocket 10 includes a combination of features that permits a user to readily and reversibly modify, length 132 (see FIG. 2) of receiving zone 104, to allow pocket 10 to properly carry, for example, a handgun having a barrel portion that is shorter than barrel portion 110 of handgun 120. More specifically, exterior surface 266 includes a base retaining device 270 and a plurality of corresponding retaining devices 272. As shown in FIG. 12, base retaining device 270, which in this exemplary embodiment includes hook-type fasteners 274, is adjacent, or otherwise proximate to, first segment 40 of base edge 44 and overlies, at least in part, receiving zone 104. The plurality of corresponding retaining devices 272 can include a first corresponding retaining device 280, a second corresponding retaining device 282, a third corresponding retaining device 284, a fourth corresponding retaining device 286, and a fifth corresponding retaining device 288. Each of the corresponding retaining devices 272 in this exemplary embodiment includes loop-type fasteners 290. In an alternate embodiment, base retaining device 270 includes loop-type fasteners, and the plurality of corresponding retaining devices 272 include hook-type fasteners 274. Hook and loop-type fastener systems marketed under the trademark Velcro® are among those that are suitable for use in this application. Other readily-releasable fastener systems, including (without limitation) snaps or adhesives or buttons and holes, may be used instead of, or in combination with, hook and loop-type fastener systems. Base retaining device 270 and the plurality of corresponding retaining devices 272 are fastened (e.g., seamed or sewn) to inner part 260.

In the exemplary embodiment shown in FIG. 12, which shows a rear view of pocket 10, the plurality of corresponding retaining devices 272 are positioned on exterior surface 266 in a series that can vary in distance from first segment 40 of base edge 44 and, hence, from base retaining device 270. First corresponding retaining device 280, which is positioned between base retaining device 270 and second corresponding retaining device 282, overlies a first portion of receiving zone 104. Second corresponding retaining device 282, which is positioned between first corresponding retaining device 280 and third corresponding retaining device 284, overlies a second portion of receiving zone 104. Third corresponding retaining device 284, which is positioned between second corresponding retaining device 282 and fourth corresponding retaining device 286, overlies a third portion of receiving zone 104. Fourth corresponding retaining device 286, which is positioned between third corresponding retaining device 284 and fifth corresponding retaining device 288, overlies a fourth portion of receiving zone 104. Fifth corresponding retaining device 288 can be positioned proximal to inner edge 66 and overlie a portion of first region 90 that is located at a distance from receiving zone opening 300 corresponding to the length of receiving zone 132.

Figure 13A:
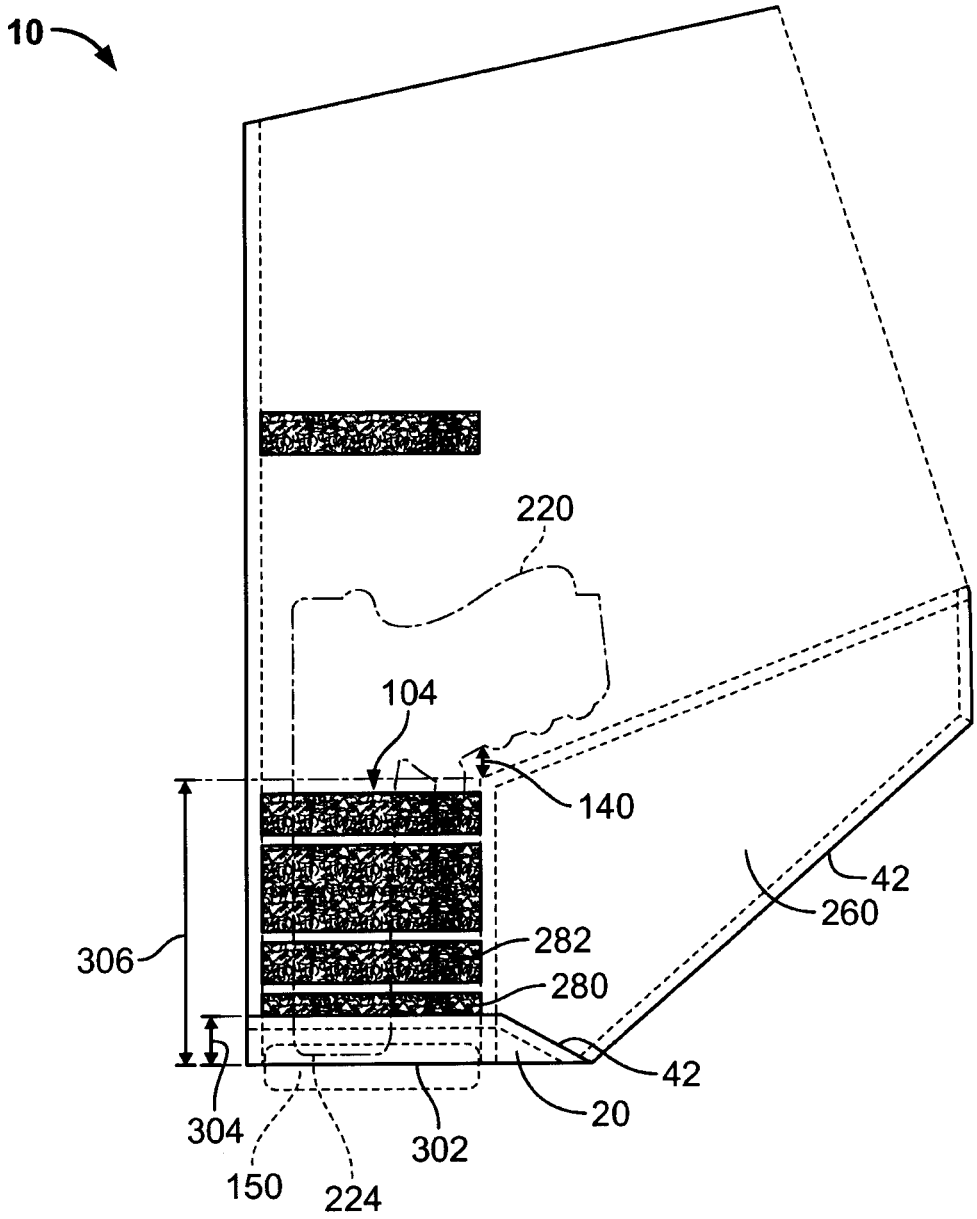
FIGS. 13A-13C show rear plan views of an exemplary embodiment of a sewn garment pocket in varying folded configurations to carry handguns of varying barrel length.
Figure 13B:
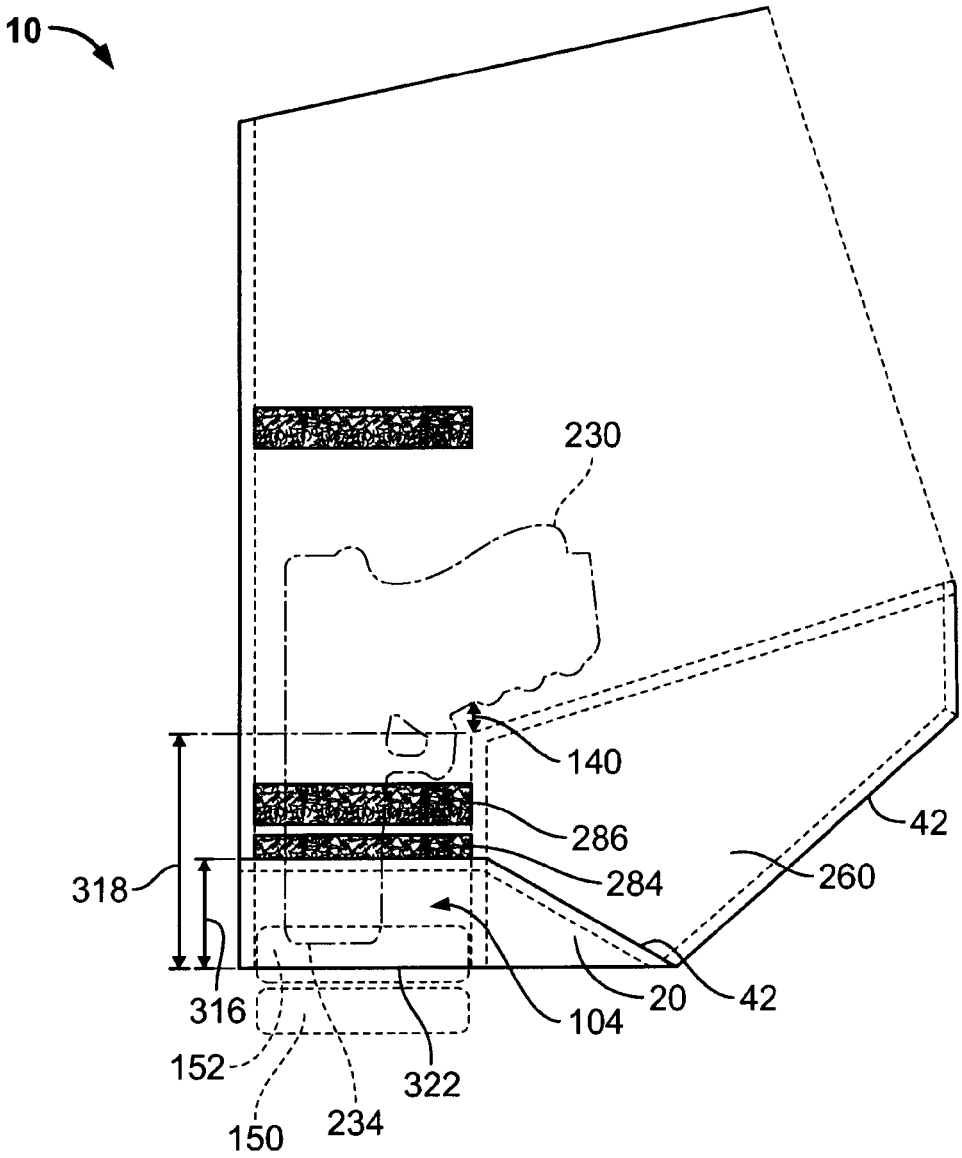
Figure 13C:
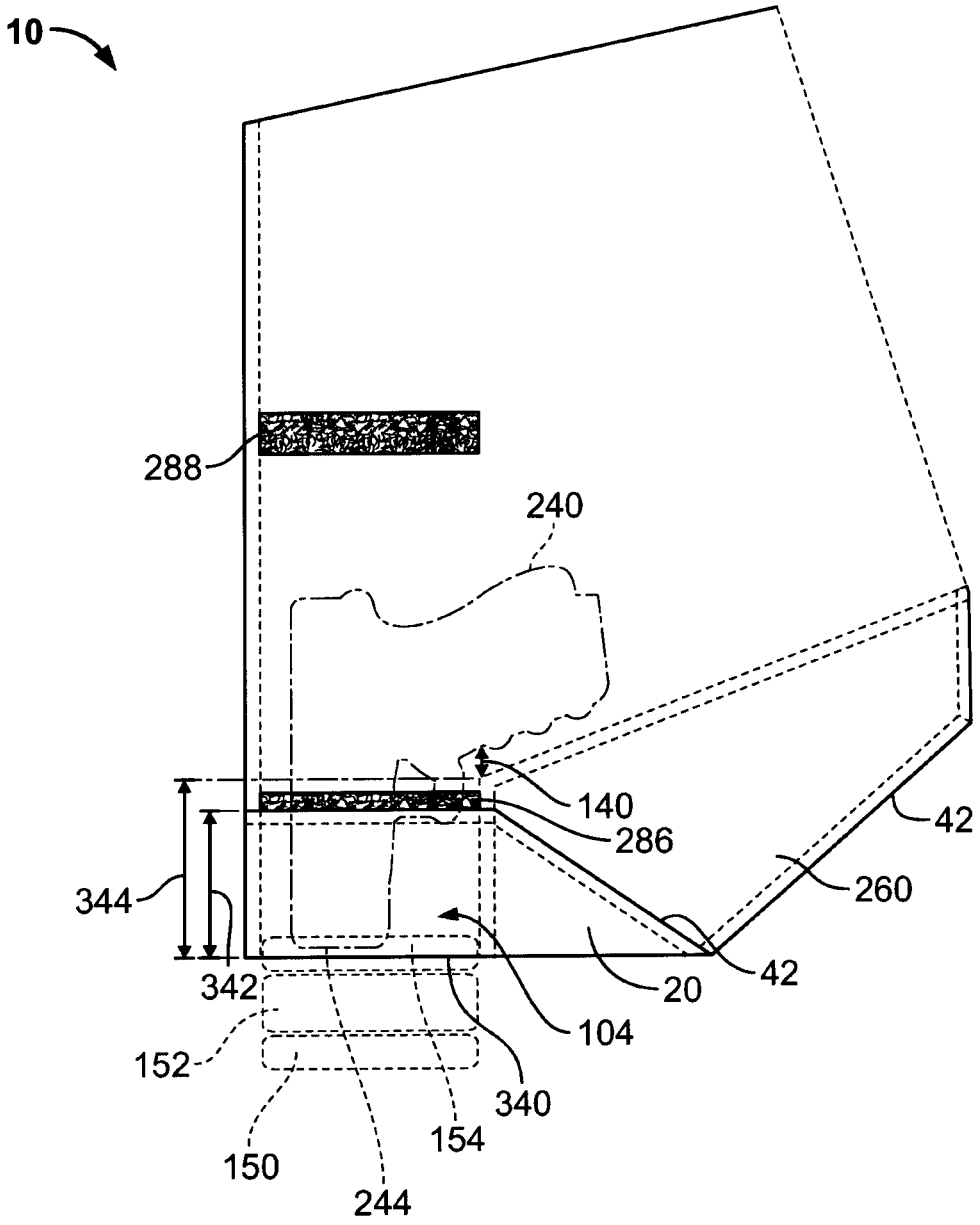

FIGS. 13A-13C show how the foregoing combination of features permit a wearer of pocket 10 to properly carry therein handguns having a shorter barrel portion than handgun 120 (see FIG. 2), without having to physically shorten first seam 102 or inner edge 66. As shown in FIG. 13A, base retaining device 270 (see FIG. 12) can be fastened to first corresponding retaining device 280 by folding pocket 10 such that base retaining device 270 mates with first corresponding retaining device 280. The formation of fold 302 can decrease the length of receiving zone 104 by a length 304, yielding an operative receiving zone length 306 and corresponding accessible area of receiving zone 104. When pocket 10 is in the configuration shown in FIG. 13A, handgun 220 is carried in pocket 10 in an ergonomic orientation. Muzzle 224 contacts and is supported by fold 302, which overlies first receiving-zone sub-region 150 (see also, FIG. 11A). Finger gap 140 is present.

In another example, which is shown in FIG. 13B, base retaining device 270 (see FIG. 12) can be fastened to third corresponding retaining device 284 by folding pocket 10 such that base retaining device 270 mates with third corresponding retaining device 284. The formation of fold 322 can decrease the length of receiving zone 104 by a length 316, yielding an operative receiving zone length 318. When pocket 10 is in the configuration shown in FIG. 13B, handgun 230 is carried in pocket 10 in an ergonomic orientation. Muzzle 234 contacts and is supported by fold 322, which overlies second receiving-zone sub-region 152 (see also, FIG. 11B). Again, finger gap 140 is present. In still another example, which is shown in FIG. 13C, base retaining device 270 (see FIG. 12) can be fastened to fourth corresponding retaining device 286 by folding pocket 10 such that base retaining device 270 mates with fourth corresponding retaining device 286. The formation of fold 340 can decrease the length of receiving zone 104 by a length 342, yielding an operative receiving zone length 344. When pocket 10 is in the configuration shown in FIG. 13C, handgun 240 is carried in pocket 10 in an ergonomic orientation. Muzzle 244 contacts and is supported by fold 340, which overlies third receiving-zone sub-region 154 (see also, FIG. 11C). Again, finger gap 140 is present.

As shown in FIGS. 12 and 13A-13C, pocket 10 includes a plurality of corresponding retaining devices 272. Gaps 350 (see FIG. 12) between each of corresponding retaining devices 280, 282, 284, 286 serve as lines along which the wearer can fold pocket 10 relatively easily when changing configurations. Additionally, telegraphing of pocket 10 is reduced when a fold coincides with a gap 350, relative to when a fold does not coincide with a gap 350, because fewer layers of material are present along the fold, thereby resulting in a fold having a reduced profile. In an alternate embodiment, a single, relatively large corresponding retaining device could be used in place of first, second, third and fourth retaining devices 280, 282, 284, 286. In another alternate embodiment, base retaining device 270 and the plurality of corresponding retaining devices 272 are disposed on exterior surface 354 of outer part 20 (see FIG. 2), instead of on exterior surface 266 of inner part 260 (see FIG. 12). Also, in still another alternate embodiment, the plurality of corresponding retaining devices 272 can include fewer than five, or greater than five, corresponding retaining devices. For example, second corresponding retaining device 282 (see FIG. 12) can be omitted in an alternate embodiment.

Figure 14:
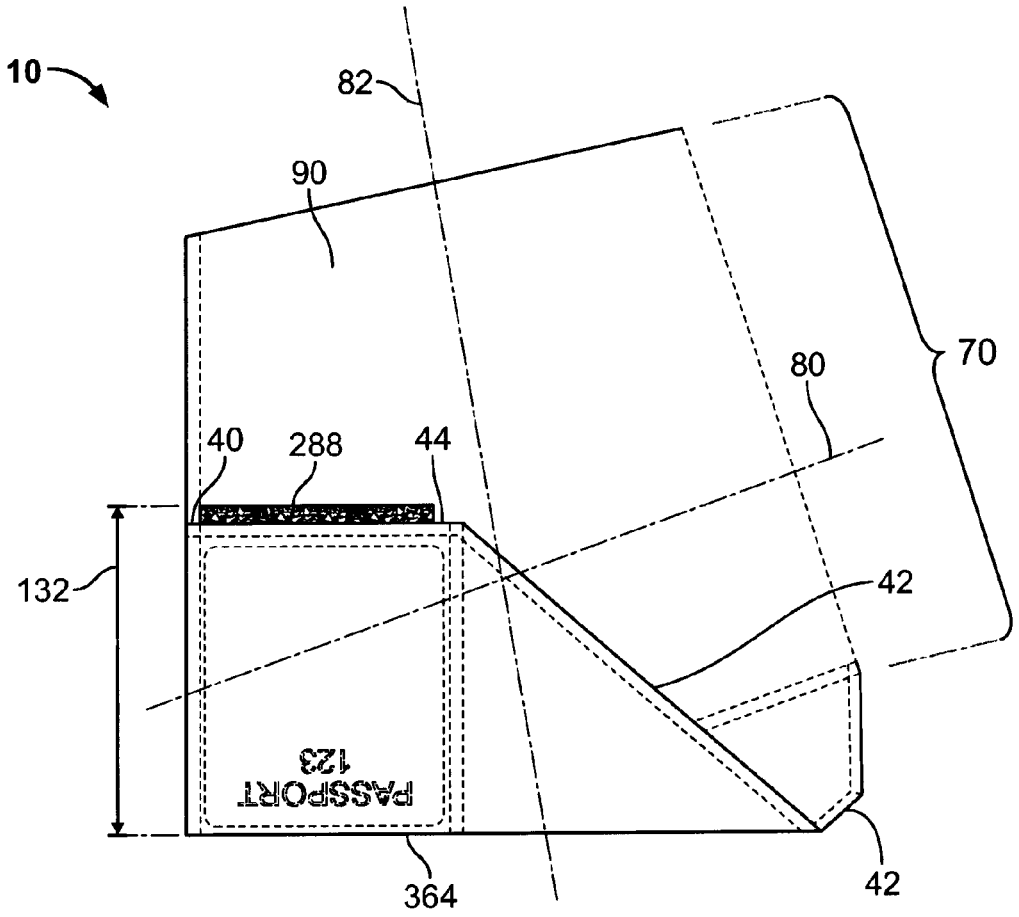
FIG. 14 shows a rear plan view of an exemplary embodiment of a sewn garment pocket carrying a passport.

FIG. 14 shows how the foregoing combination of features permits a wearer of pocket 10 to carry relatively small items (e.g., passport, wallet, keys, jewelry) therein. Base retaining device 270 (see FIG. 12) can be fastened to fifth corresponding retaining device 288 by folding pocket 10 such that base retaining device 270 mates with first corresponding retaining device 288. When folded, receiving zone opening 300 is substantially flush with fold 364. The presence of a fold 364 provides support for passport 360, which is enclosed within receiving zone 104 by fold 364, inner edge 40 of base edge 44, inner edge 66, and first seam 102. Pocket 10, when used in this configuration to carry a small item (e.g., passport, wallet, keys, jewelry), reduces the risk that the small item will be lost.

Figure 15:
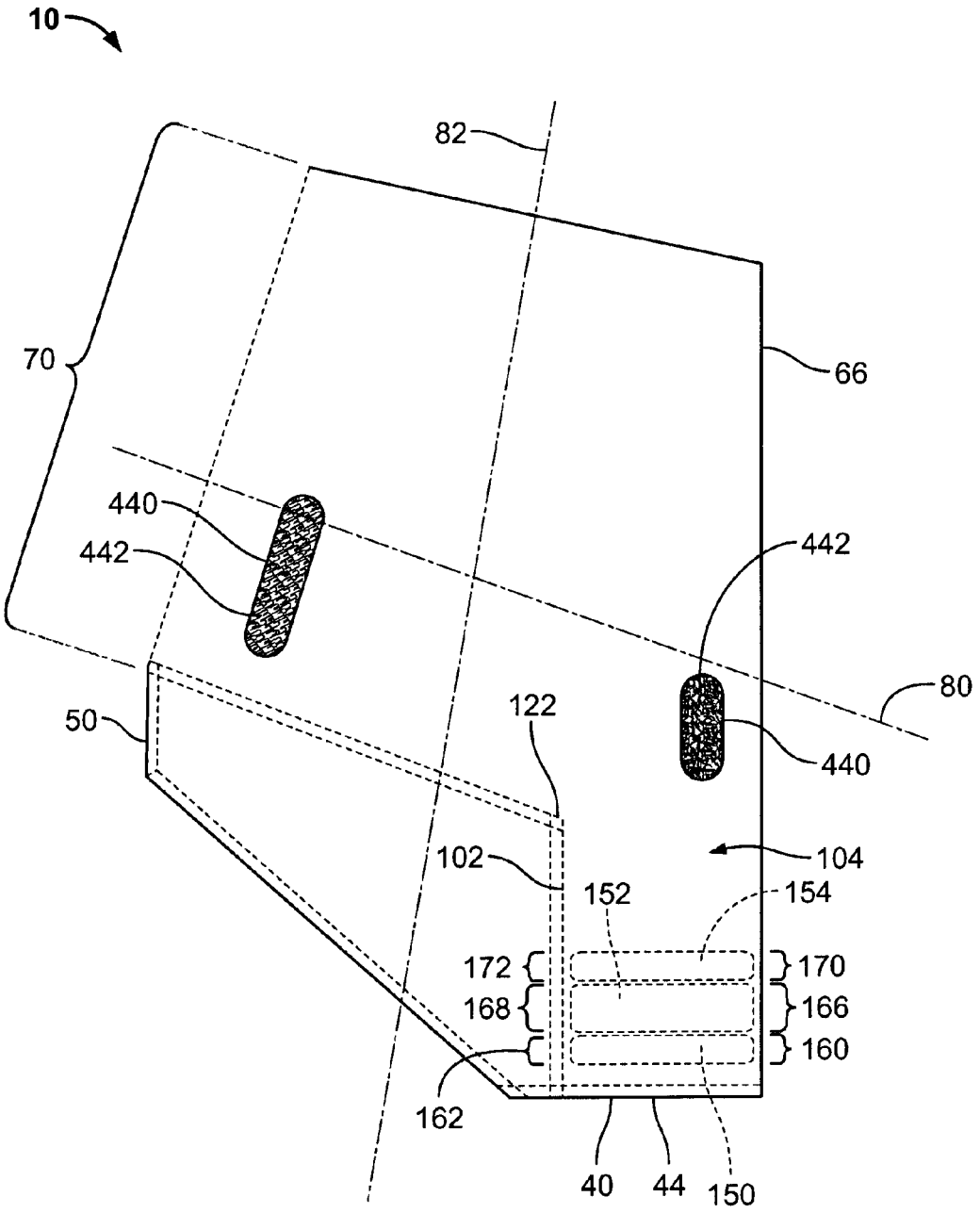
FIGS. 15 and 16 show front plan views of an exemplary embodiment of a sewn garment pocket without and with an exemplary anti-telegraphing device.
Figure 16:
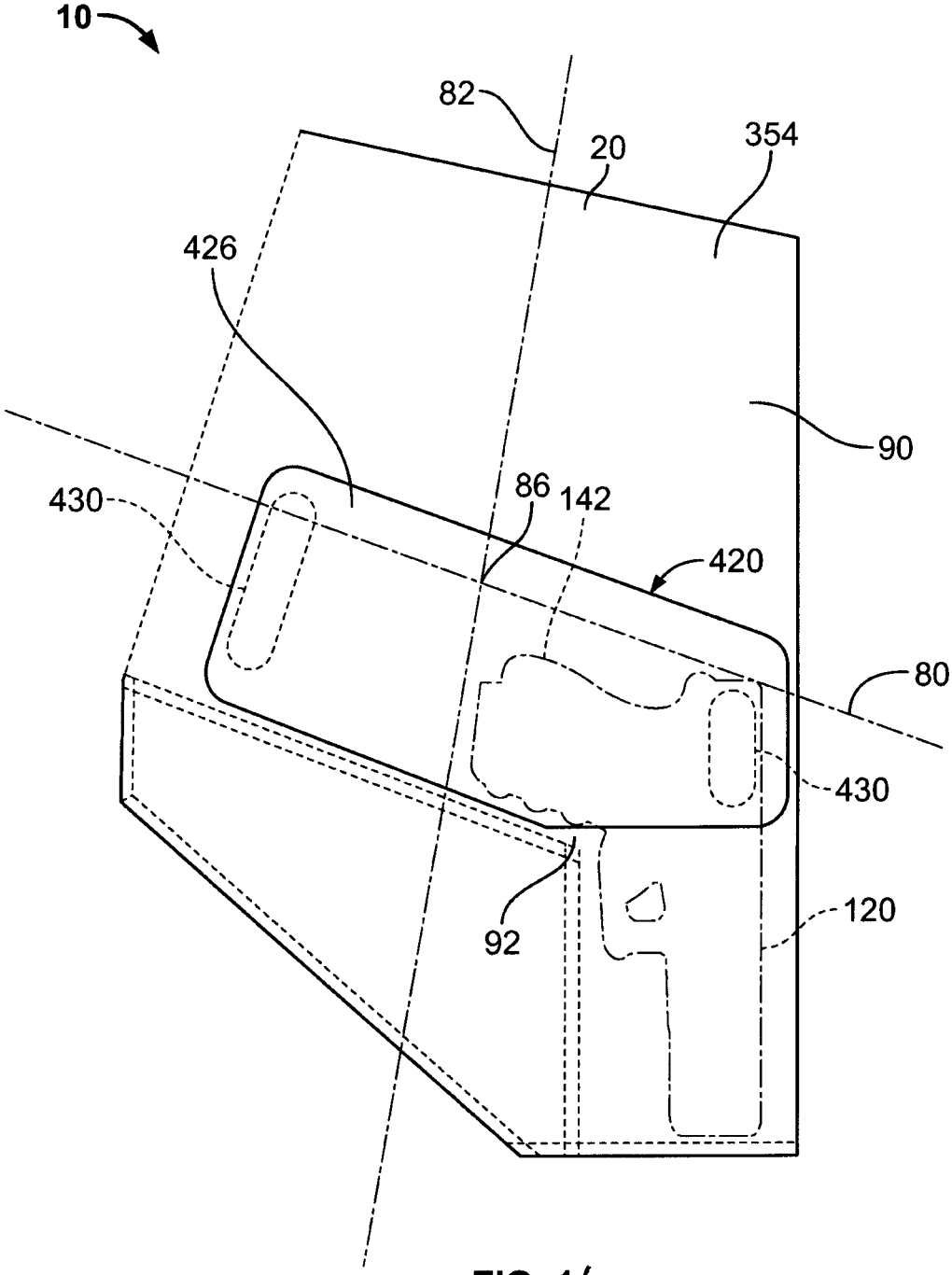

FIG. 15 shows the adjustable pocket 10 of FIG. 9 with features 440 and 442 that can be used to attach an anti-telegraphing device. FIG. 16 shows pocket 10 having anti-telegraphing device 420 deployed thereon. Anti-telegraphing device 420 mediates contact between exterior surface 354 of pocket 10 and the wearer's pants. Thus, some of the protrusions or other irregularities in exterior surface 354 that arise when handgun 120 is being carried in pocket 10 are translated less efficiently into visible protrusions or irregularities in the surface of the wearer's pants, thus reducing telegraphing. The smooth profile of anti-telegraphing device 420 aids in concealing handgun 120 by rounding out some of these protrusions and other irregularities caused by handgun 120, especially those caused by grip 142.

Figure 17A:
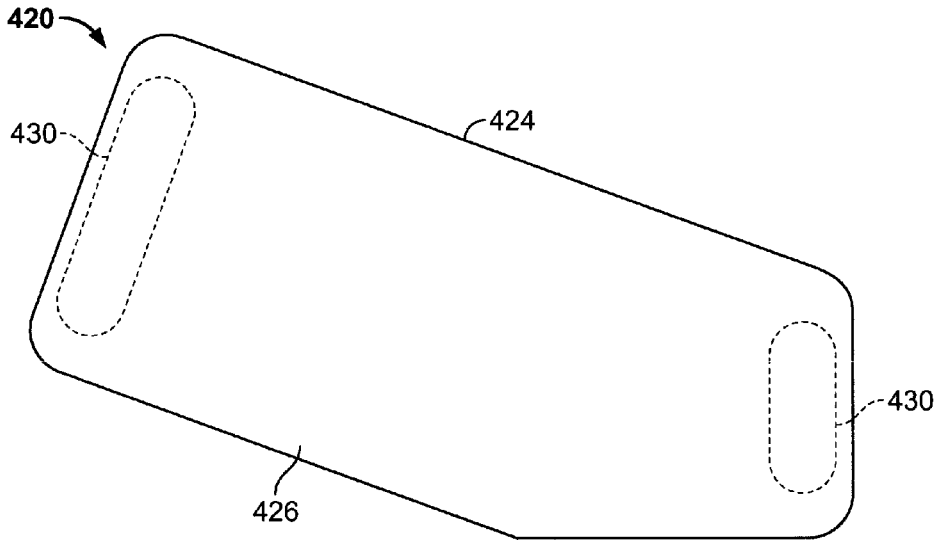
FIGS. 17A-17C show top, bottom and side views of an exemplary embodiment of an anti-telegraphing device for a garment pocket.
Figure 17B:
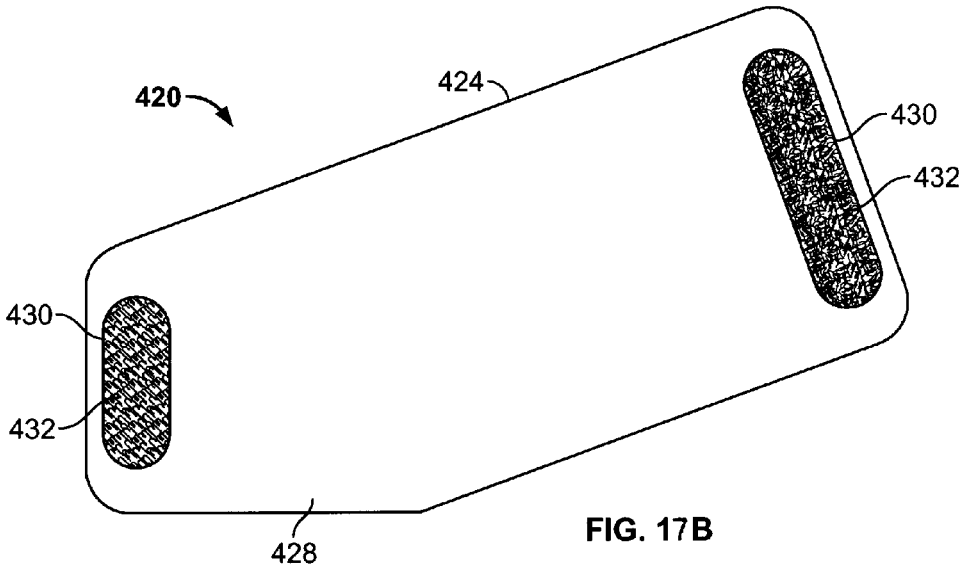
Figure 17C:
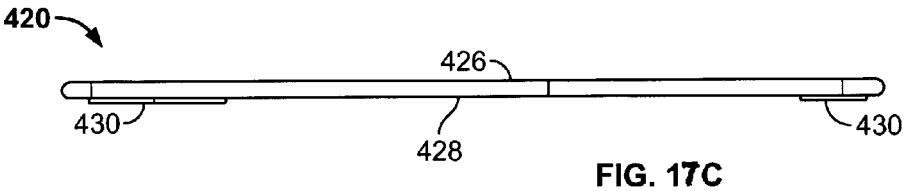

In the embodiment of FIGS. 17A-17C, anti-telegraphing device 420 includes a sheet of flexible material 424 having a first major surface 426 and an opposing second major surface 428. Exemplary flexible materials include resilient polymeric materials (e.g., ultra-high molecular weight polyethylene), plastic materials (e.g., polyoxymethylene plastic), nylon 6-6, or paper stock of suitable thickness. Second major surface includes one or more retaining devices 430, which in this exemplary embodiment includes hook-type fasteners 432. Retaining devices 430 are positioned and oriented on second major surface 428 to allow the wearer to fasten anti-telegraphing device 420 to pocket 10 by way of corresponding retaining devices 440 included on exterior surface 354 of outer part 20. As shown in FIG. 15, corresponding retaining devices 440 include loop-type fasteners 442, which are configured to mate hook-type fasteners 432 of retaining devices 430. In an alternate embodiment, retaining devices 430 include loop-type fasteners, and corresponding retaining devices 440 include hook-type fasteners 432. Other readily-releasable fastener systems, including (without limitation) snaps or adhesives, may be used instead of, or in combination with, hook and loop-type fastener systems. Retaining devices 430 are attached to the sheet of flexible material 424 by adhesive or other suitable method. Corresponding retaining devices 440 can be fastened (e.g., seamed or sewn) to outer part 20.

In an alternate embodiment, anti-telegraphing device 420 may be permanently fused to, bonded to, or sewn into exterior surface 354. In such instances, anti-telegraphing device 420 may be composed of a medium-to-heavyweight coarsely woven cotton or cotton and polyester blend, such as osnaburg. In other such instances, anti-telegraphing device 420 may be composed of non-woven support fabric. Anti-telegraphing device 420 may also take different shapes and sizes.

Figure 18:
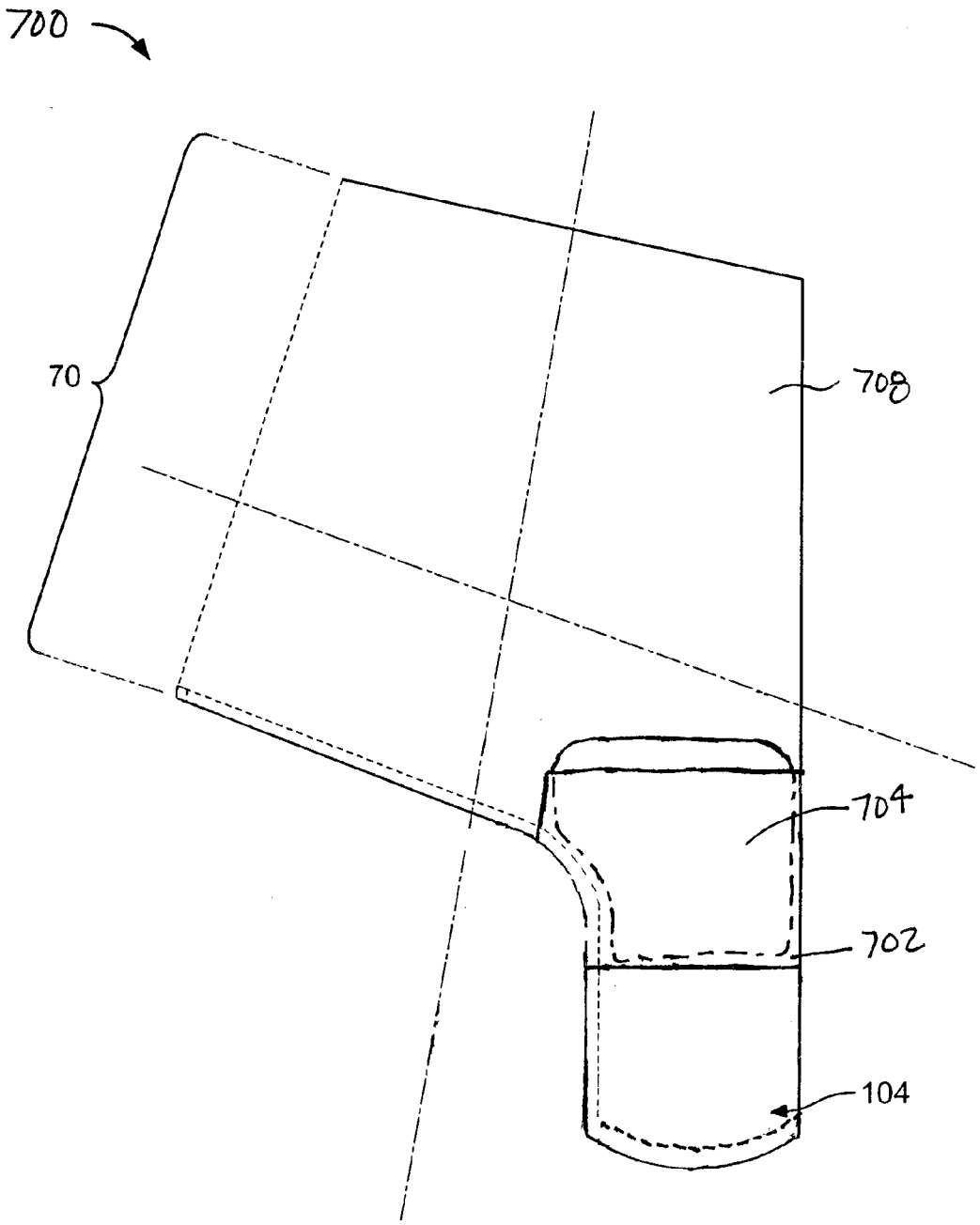
FIGS. 18 and 19 show a front plan view of an exemplary embodiment of a garment pocket with an exemplary trigger guard shield.
Figure 19:
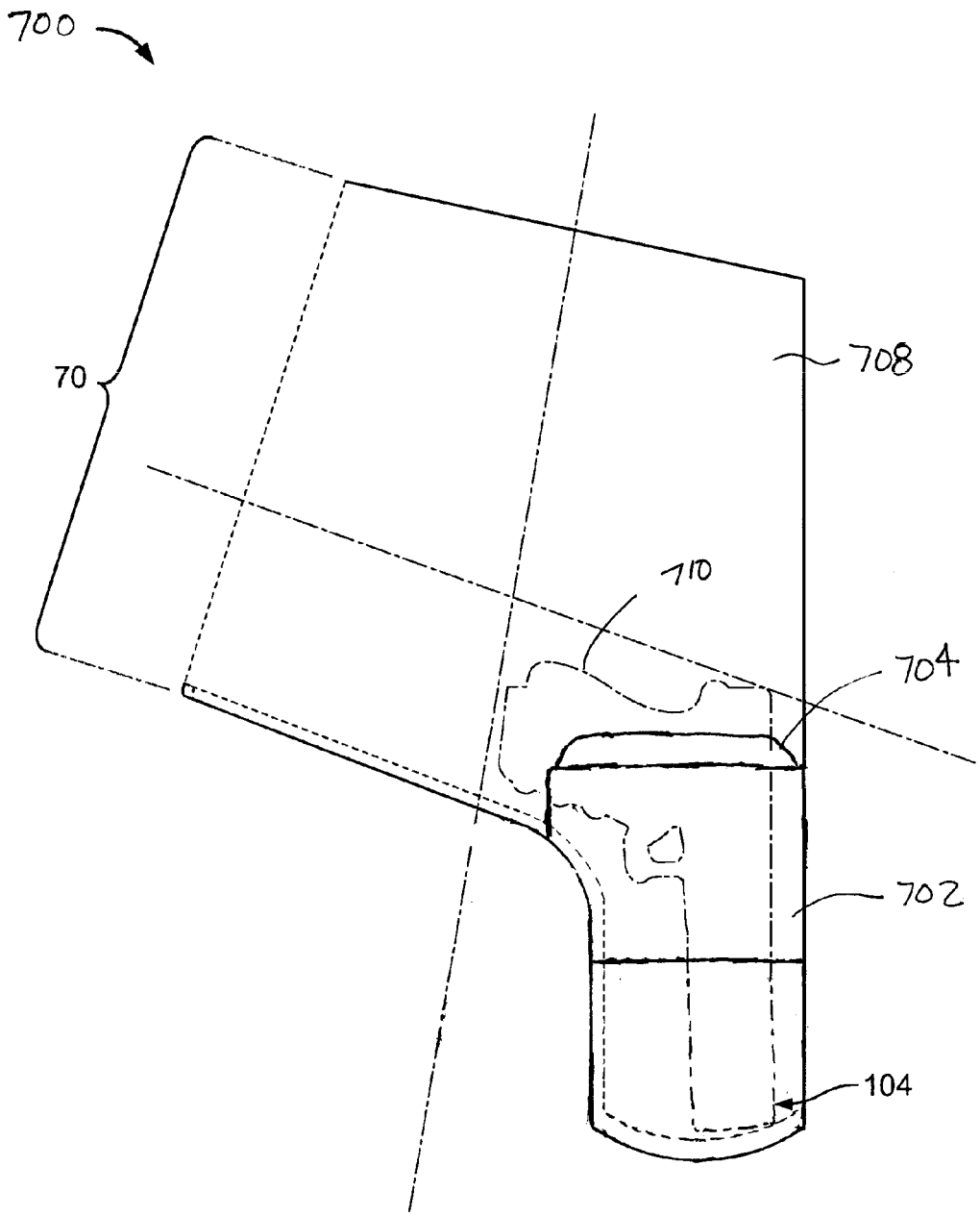

FIGS. 18 and 19 show an exemplary embodiment of an alternative pocket with a trigger guard shield. Pocket 700 includes a pouch or sleeve 702 that can hold trigger guard shield 704. The use of the pouch or sleeve 702 with pocket 700 permits the trigger guard shield 704 to be inserted and removed as desired by the wearer. Trigger guard shield 704 is a solid piece of material that has some flexibility, but can still maintain its original shape. In one embodiment, trigger guard shield 704 can be made from a plastic material (e.g., polyoxymethylene plastic), nylon 6-6, paper stock or polymeric material (e.g., ultra-high molecular weight polyethylene). The trigger guard shield 704 can have a thickness of about 0.010 inches to about 0.015 inches. Pouch 702 can be fastened (e.g., seamed or sewn) to the outer or exterior surface 708 of pocket 700. Outer surface 708 of pocket 700 faces the garment, e.g., pants, worn by the wearer. When the trigger guard shield 704 is inserted into pouch 702, the trigger guard shield 704 provides a smooth surface over handgun 710 (see FIG. 19) and blends into the remaining portion of outer surface 708 to assist in the concealing of handgun 710. The trigger guard shield 704 can reduce or minimize protrusions or other irregularities in exterior surface 708 of pocket 700 caused when a handgun 710 is being carried in pocket 700 by providing a continuous smooth surface that rounds out the protrusions and other irregularities caused by the handgun 710, especially protrusions and irregularities caused by the grip of the handgun.

In another exemplary embodiment, the shape of trigger guard shield 704 can correspond to the size of the pouch or sleeve 702 fastened to the pocket 700. The pouch or sleeve 702 can extend further into receiving zone 104 to provide additional shielding to the barrel portion of the handgun and/or can extend away from receiving zone 104 to provide additional shielding to the grip of the handgun. In a further embodiment, pouch 702 can be omitted and trigger guard shield 704 can be attached directly to outer surface 708 using fasteners similar to the fasteners used with anti-telegraphing device 420.

In addition to further concealing the handgun 710, trigger guard shield 704 can also operate as a trigger guard for handgun 710. The solid structure of trigger guard shield 704 prevents another person from intentionally or inadvertently discharging the handgun by pulling the trigger through the materials of the garment and pocket. The trigger guard shield 704 deflects any attempt to reach the trigger from outside of the pocket 700 or garment, i.e., trigger guard shield 704 can prevent an object such as a person's finger from being inserted in the trigger guard from a position external to the pocket 700 or garment and thus prevents the discharge of the handgun as a result of actions occurring outside of the pocket or garment.

In another exemplary embodiment, a trigger guard shield can be formed in the pocket for the garment by fastening (e.g., seaming or sewing) one or more woven strips of fabric into the pocket at a location that corresponds to the expected position of the trigger guard of a handgun. The woven strips of fabric can be made from a medium-to-heavyweight coarsely woven cotton, cotton and polyester blend, wool or other suitable all natural or man-made fiber based material. The woven strips of fabric provide additional rigidity and can make it difficult for an object such as a person's finger to be inserted in the trigger guard from a position external to the pocket or garment.

In still other exemplary embodiments, the pouch 702 and trigger guard shield 704 can be used with pockets incorporating the adjustable depth or receiving zone feature (see e.g., FIG. 12), the retainer feature (see e.g., FIGS. 6A and 7A) and/or the enlarged pocket opening feature (see e.g., FIG. 5).

In one embodiment, the anti-telegraphing device 420, the sheet of flexible material 424 and/or the trigger guard shield 704 can be referred to as a means for reducing protrusions. The retaining devices 430 and 440 and/or the pouch or sleeve 702 can be referred to as a means for holding the means for reducing protrusions.

Figure 20:
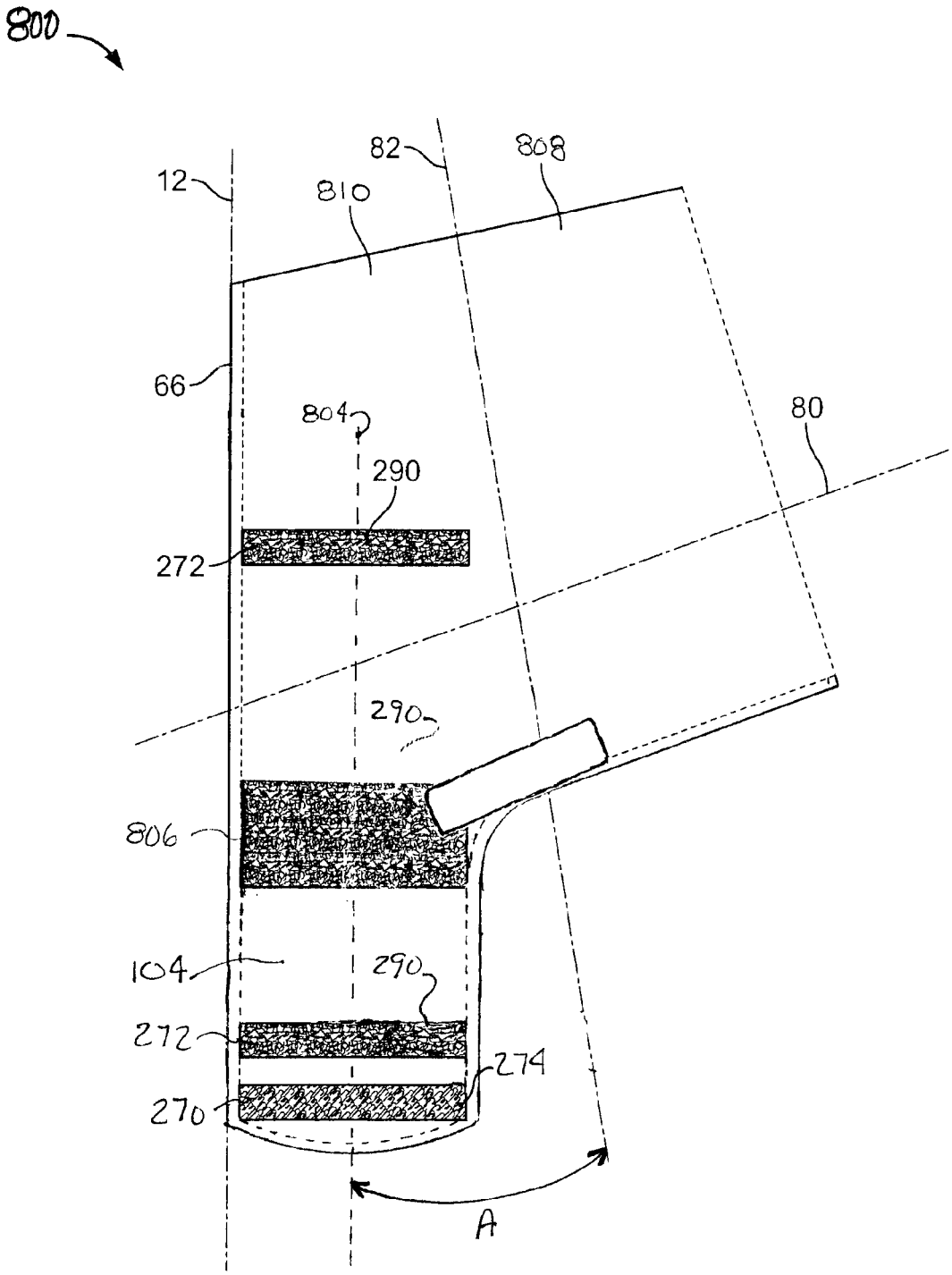
FIGS. 20-22 show rear plan views of an exemplary embodiment of a garment pocket at different pitch positions.
Figure 21:
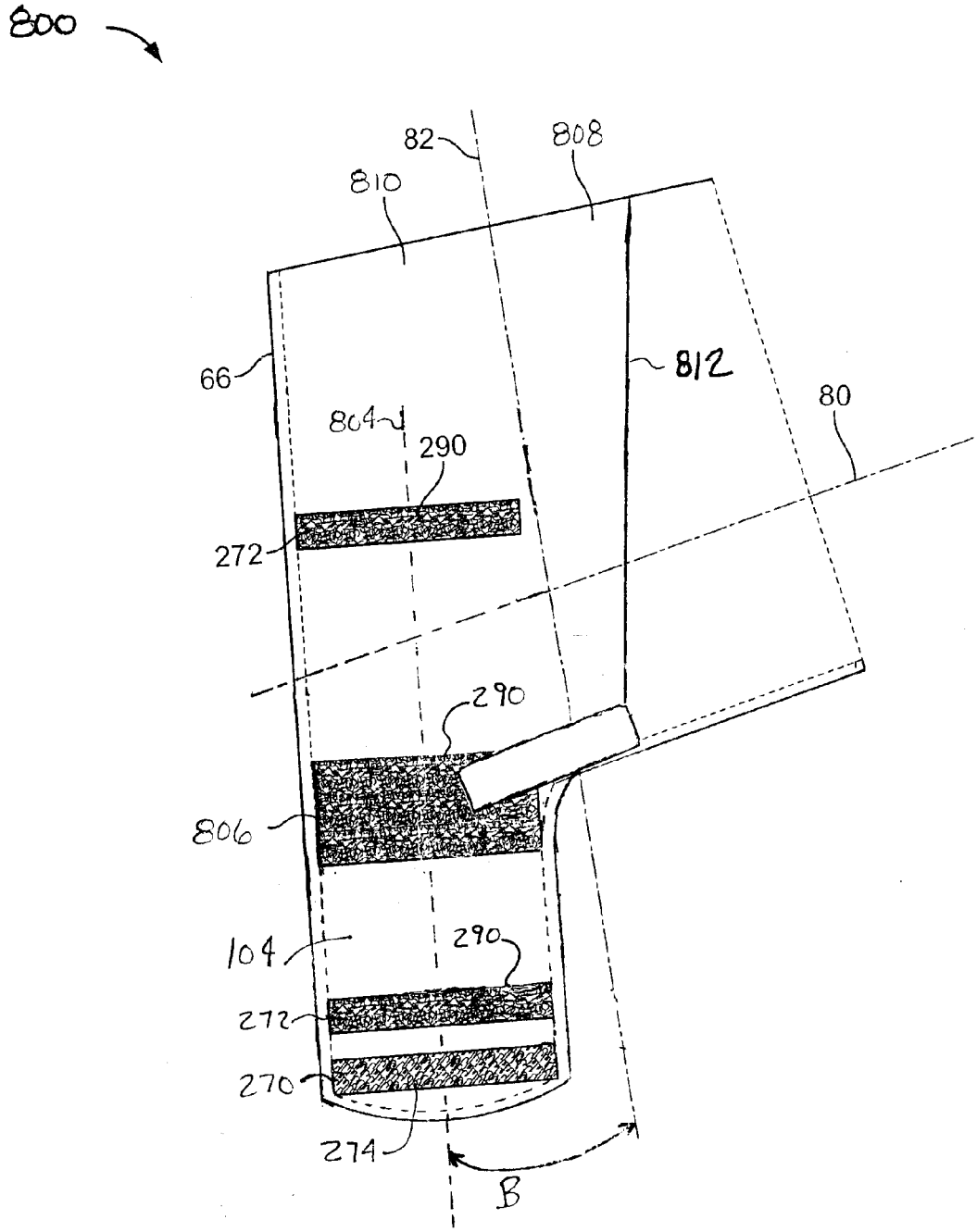
Figure 22:
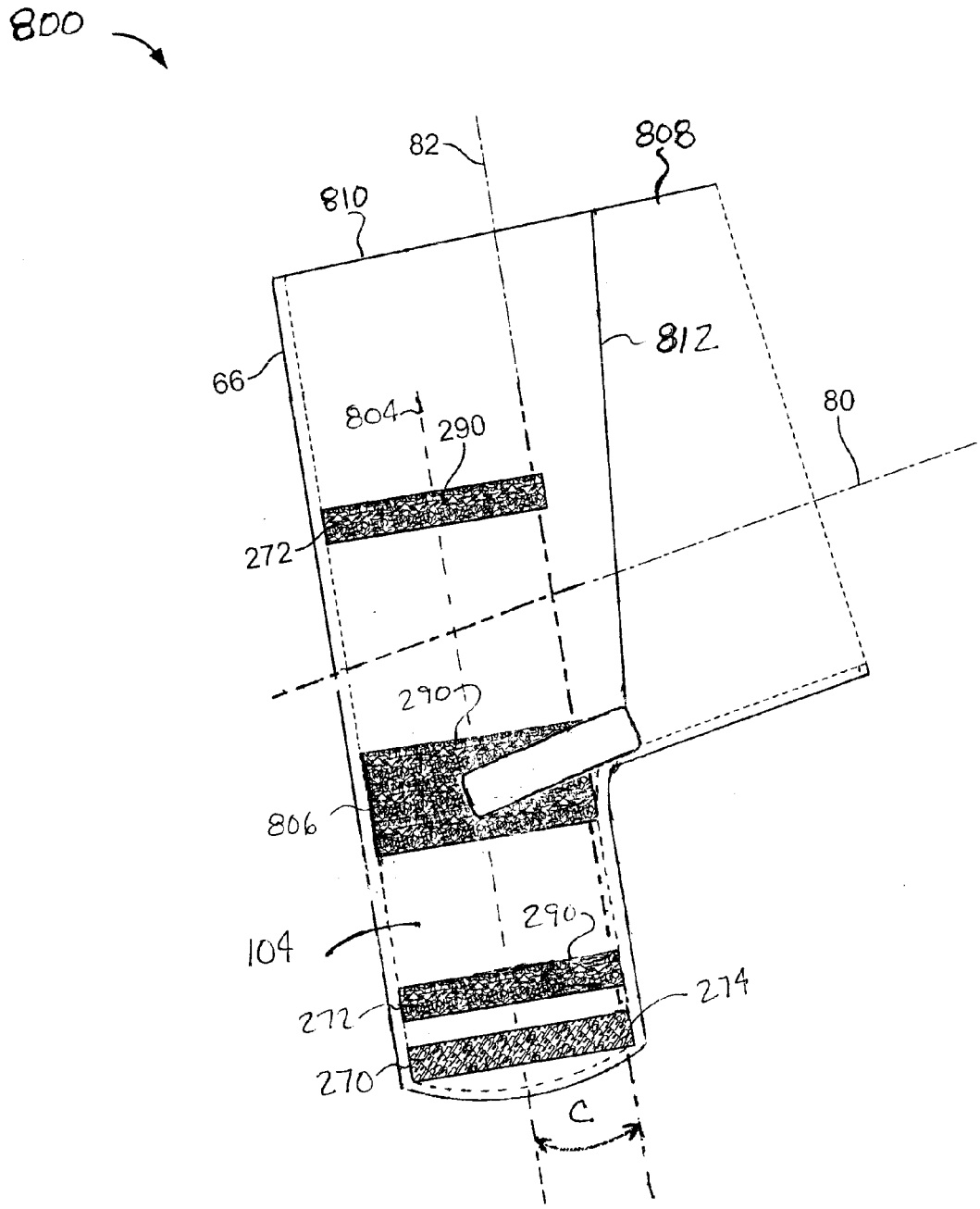

FIGS. 20-22 show an exemplary embodiment of a pocket having an adjustable pitch feature. The adjustable pitch feature permits the pocket to be varied for the comfort of the wearer and/or to maintain concealment of a handgun in the receiving zone or area regardless of the size, shape and weight of the wearer and the size, weight and shape of the handgun being carried in the receiving area. Pocket 800 includes a tab or strap 802 that can releasably engage with a retaining portion 806 of pocket 800 to adjust the pitch of the receiving zone or area 104 and thus pocket 800. The pitch of receiving area 104 (or pocket 800) can be defined as the angle between the centerline of the wearer's thigh 82 and the centerline of the receiving area 804. Tab 802 can be fastened (e.g., seamed or sewn) to the exterior surface 808 of inner part 810 of pocket 800, which inner part 810 and exterior surface 808 faces the wearer. When adjusting the pitch of the receiving area 104 or pocket 800, the handgun in pocket 800 may be shifted laterally away from inner edge 66. In addition, the handgun in pocket 800 may also be shifted towards the line of flexion corresponding to the wearer's hip joint 80.

Tab or strap 802 can be fabricated from cloth or other suitable material. In one embodiment, retaining area 806 and tab 802 can use a hook and loop-type fastener system to adjust the pitch of the receiving area 104. As shown in FIGS. 20-22, retaining area 806 can include loop-type fasteners 290 that can connect to hook-type fasteners on tab 802. However, in other embodiments, retaining area 806 can use hook-type fasteners and tab 802 can use loop-type fasteners. In still other embodiments, tab 802 and retaining area 806 can use other readily-releasable fastener systems, including (without limitation) snaps or adhesives, instead of, or in combination with, a hook and loop-type fastener system.

FIG. 20 shows pocket 800 in a first pitch position as defined by the angle A. The first pitch position for the pocket 800 has tab 802 and retaining area 806 in an untensioned position, i.e., tab 802 does not pull or draw on retaining area 806, even though tab 802 is shown connected to retaining area 806. In an alternate embodiment, tab 802 and retaining area 806 may be disconnected when the pocket 800 is in the first pitch position.

FIG. 21 shows pocket 800 in a second pitch position as defined by the angle B. The angle B is smaller than angle A from FIG. 20, which corresponded to the first pitch position. The second pitch position for the pocket 800 has tab 802 and retaining area 806 in a tensioned position, i.e., tab 802 pulls or draws retaining area 806 toward the centerline of the wearer's thigh 82 and as a result, moves the receiving zone or area 104 towards the centerline of the wearer's thigh 82. In order to accommodate the movement of the receiving area 104 towards the centerline of the wearer's thigh 82, a fold or crease 812 can be made in the material of pocket 800.

FIG. 22 shows pocket 800 in a third pitch position as defined by the angle C. The angle C is smaller than both angles A and B from FIGS. 20 and 21, which corresponded to the first and second pitch positions. The angle C in FIG. 22 is approaching 0 degrees which indicates that the centerline of the receiving area 804 is substantially parallel with the centerline of the wearer's thigh 82. The third pitch position for the pocket 800 has tab 802 and retaining area 806 in a tensioned position similar to FIG. 21, except that tab 802 is placed on retaining area 806 closer to inner edge 66 than the placement of tab 802 for the second pitch position. In order to accommodate the movement of the receiving area 104 towards the centerline of the wearers thigh 82, a fold or crease 812 can be made in the material of pocket 800.

In another exemplary embodiment, the pitch of the receiving zone 104 or pocket 800 can be varied to almost angle based on the placement of the tab 802 on the retaining area 806. In addition, the tab 802 may be placed on retaining area 806 such that the centerline of the receiving area 804 intersects the centerline of the wearer's thigh 82.

In still other exemplary embodiments, the tab 802 and adjustable pitch capability can be used with pockets incorporating the pouch and trigger guard shield feature (see e.g., FIG. 19), the adjustable depth or receiving zone feature (see e.g., FIG. 12), the retainer feature (see e.g., FIGS. 6A and 7A) and/or the enlarged pocket opening feature (see e.g., FIG. 5).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pant garment for a person comprising:

the pant garment having an outer layer with an inseam, a waistband, and leg portions;

a pocket covered by the outer layer, the pocket comprising a first part having an exterior surface and an interior surface, the exterior surface of the first part is located behind the outer layer, a second part located opposite the interior surface of the first part, a partially-enclosed space positioned between the interior surface of the first part and the second part, and the partially-enclosed space comprising a region defined by:

a first line corresponding substantially to a line of flexion of a hip joint of a garment, a second line corresponding substantially to a centerline of a thigh of the garment; and a third line corresponding substantially to the inseam;

the region comprising a partially-enclosed subspace, the partially-enclosed subspace defined by:

an inner edge disposed proximate to the inseam;

a base edge extending from the inner edge; and a seam extending from the base edge in a direction substantially parallel to the inner edge, the seam being disposed in the partially-enclosed space and aiding in orienting an object in the region;

a single pouch attached to the exterior surface of the first part, the pouch being located between the inner edge and the seam, the pouch having a closed end substantially parallel to the base edge and an open end opposite the closed end; and a guard located in the pouch for reducing protrusions in the outer layer resulting from an object being positioned in the region, wherein a portion of the guard extends from the open end of the pouch.

2. The pant garment of claim 1, wherein the guard comprises a material selected from polymeric materials, paper stock, paper fiber materials, foam and plastic bonded fabric materials.

3. The pant garment of claim 1, wherein the guard has a thickness in a range of about 0.010 inches to about 0.125 inches.

4. The pant garment of claim 1, wherein the object is a handgun, the guard is sized to completely cover a portion of the handgun inserted in the region, the portion of the handgun covered by the guard includes a trigger guard of the handgun, at least a portion of a barrel of the handgun and at least a portion of a grip of the handgun.

5. A garment comprising:

a pant garment having an outer layer, a waistline and leg portions; a pocket attached to the waistline and positioned under the outer layer, the pocket comprising:

a first layer having an exterior surface and an interior surface;

a second layer attached to the interior surface of the first layer to form a partially enclosed space;

a first edge extending along the waistline;

a second edge extending from the first edge;

a third edge positioned opposite the first edge and extending from the second edge;

a fourth edge positioned opposite the second edge and extending from the third edge to the first edge;

an first opening positioned along the fourth edge to permit access to the partially enclosed space;

a first seam extending from an intermediate point of the third edge toward the first edge for a predetermined distance to an end of the first seam, the first seam being positioned substantially parallel to the second edge over the predetermined distance;

the third edge comprising a segment, the segment extending from the second edge to the first seam;

the first seam, the segment and the second edge define a receiving zone to store an object; the first seam is positioned to orient the object in the receiving zone and to prevent lateral movement of the object in the receiving zone; and a second seam extending from the first seam to the fourth edge to guide the object into the receiving zone, the second seam intersecting the first seam at an end of the first seam opposite the segment; and a first fastener and a second fastener attached to the first layer on the exterior surface of the pocket, wherein the first fastener is positioned adjacent the second edge and the second fastener is positioned adjacent the first opening; and a guard comprising a sheet of material having an exterior surface and an interior surface for reducing protrusions in the outer layer resulting from an object being positioned in the pocket, the sheet of material having a first corresponding fastener attached at one end of the sheet of material and a second corresponding fastener attached at an opposite end of the sheet of material, the first corresponding fastener of the guard attaches to the first fastener on the first portion of the pocket and the second corresponding fastener of the guard attaches to the second fastener on the first portion of the pocket.

* * * * *